US010217414B2

(12) United States Patent
Park et al.

(10) Patent No.: US 10,217,414 B2
(45) Date of Patent: Feb. 26, 2019

(54) EMISSION CONTROL DRIVER AND DISPLAY DEVICE HAVING THE SAME

(71) Applicant: Samsung Display Co., Ltd, Yongin-si, Gyeonggi-do (KR)

(72) Inventors: Jun-Hyun Park, Suwon-si (KR); Sung-Hwan Kim, Yongin-si (KR); Kyoung-Ju Shin, Hwaseong-si (KR); Sang-Uk Lim, Yongin-si (KR); Yang-Hwa Choi, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 141 days.

(21) Appl. No.: 15/349,284

(22) Filed: Nov. 11, 2016

(65) Prior Publication Data

US 2017/0301295 A1 Oct. 19, 2017

(30) Foreign Application Priority Data

Apr. 19, 2016 (KR) ..... 10-2016-0047738

(51) Int. Cl.
*G09G 3/3258* (2016.01)
*G09G 3/3266* (2016.01)
*G09G 3/3291* (2016.01)

(52) U.S. Cl.
CPC ..... *G09G 3/3266* (2013.01); *G09G 3/3258* (2013.01); *G09G 3/3291* (2013.01); *G09G 2300/0809* (2013.01); *G09G 2300/0861* (2013.01); *G09G 2310/0286* (2013.01); *G09G 2320/043* (2013.01)

(58) Field of Classification Search
None
See application file for complete search history.

(56) References Cited

U.S. PATENT DOCUMENTS

2014/0055444 A1* 2/2014 Jang ..... G09G 3/3291 345/213
2017/0249905 A1* 8/2017 Kim ..... G09G 3/3233

FOREIGN PATENT DOCUMENTS

KR 10-2011-0110502 A 10/2011
KR 10-2013-0003252 A 1/2013
KR 10-2013-0120809 A 11/2013
KR 10-2013-0137860 A 12/2013
KR 10-2014-0025149 A 3/2014
KR 10-2014-0133033 A 11/2014
KR 10-2015-0077896 A 7/2015
KR 10-2015-0088434 A 8/2015

* cited by examiner

*Primary Examiner* — Ifedayo B Iluyomade
(74) *Attorney, Agent, or Firm* — Innovation Counsel LLP

(57) ABSTRACT

An emission control driver includes a plurality of stages configured to output a plurality of emission control signals, respectively. Each stage includes an input circuit for receiving a previous emission control signal from one of previous stages or a vertical start signal, and configured to control a voltage of a first node and a voltage of a second node in response to a first clock signal; a stabilizing circuit for stabilizing the voltage of the first node in response to the voltage of the second node and a second clock signal; a voltage adjusting circuit connected between the second node and a third node, configured for boosting the voltage of the second node, and controlling the boosted voltage of the second node; and an output circuit configured to control an emission control signal in response to the voltage of the first node and a voltage of the third node.

24 Claims, 20 Drawing Sheets

EMISSION CONTROL DRIVER AND DISPLAY DEVICE HAVING THE SAME

CROSS REFERENCE TO RELATED APPLICATION

This application claims priority under 35 U.S.C. § 119 to Korean Patent Application No. 10-2016-0047738 filed on Apr. 19, 2016, the disclosure of which is hereby incorporated by reference herein in its entirety.

BACKGROUND

1. Technical Field

Example embodiments of the inventive concept relate generally to display devices. More particularly, example embodiments of the inventive concept relate to emission control drivers and display devices having such emission control drivers.

2. Description of the Related Art

Generally, a conventional flat panel display device includes a display panel and a panel driver. The display panel includes a plurality of data lines, a plurality of scan lines, a plurality of emission control lines, and a plurality of pixels. The panel driver includes a data driver providing data signals to the gate lines, a scan driver providing scan signals to the scan lines, and an emission control driver providing emission control signals to the emission control lines.

The emission control driver includes a plurality of stages outputting emission control signals to the emission control lines, respectively. Each stage includes a plurality of transistors and capacitors. When a voltage level of power voltage applied to the emission control driver increases to drive a large-scale display device, threshold voltages of transistors are changed significantly over time. Eventually, the emission control signals can no longer be output.

SUMMARY

Example embodiments provide an emission control driver capable of more stably outputting emission control signals.

Example embodiments provide a display device having such an emission control driver.

According to some example embodiments, an emission control driver may include a plurality of stages configured to output a plurality of emission control signals respectively. Each stage may include an input circuit configured to receive a previous emission control signal from one of previous stages or a vertical start signal, and configured to control a voltage of a first node and a voltage of a second node in response to a first clock signal; a stabilizing circuit configured to stabilize the voltage of the first node in response to the voltage of the second node and a second clock signal; a voltage adjusting circuit connected between the second node and a third node, the voltage adjusting circuit configured to boost the voltage of the second node, and configured to control the boosted voltage of the second node; and an output circuit configured to control an emission control signal in response to the voltage of the first node and a voltage of the third node.

In example embodiments, the voltage adjusting circuit may include a node transistor including a gate electrode configured to receive a first power voltage, a first electrode connected to the second node, and a second electrode connected to a fourth node, a first voltage adjusting transistor including a gate electrode connected to the fourth node, a first electrode configured to receive a third clock signal, and a second electrode connected to a fifth node, a voltage adjusting capacitor including a first electrode connected to the fourth node and a second electrode connected to the fifth node, and a second voltage adjusting transistor including a gate electrode configured to receive the second clock signal, a first electrode connected to the fifth node, and a second electrode connected to the third node.

In example embodiments, the third clock signal may be substantially the same as the second clock signal.

In example embodiments, a voltage of the third clock signal corresponding to a first logic level may be lower than a voltage of the second clock signal corresponding to the first logic level.

In example embodiments, each stage may further include a load reducing circuit including a node capacitor having a first electrode configured to receive the first clock signal and a second electrode connected to the second node.

In example embodiments, the stabilizing circuit may include a first stabilizing transistor including a gate electrode connected to the second node, a first electrode configured to receive a second power voltage, and a second electrode connected to a sixth node, a second stabilizing transistor including a gate electrode connected to the second node, a first electrode connected to the sixth node, and a second electrode, and a third stabilizing transistor including a gate electrode configured to receive the second clock signal, a first electrode connected to the second electrode of the second stabilizing transistor, and a second electrode connected to the first node.

In example embodiments, each stage may further include a first leakage current blocking circuit configured to control a voltage of the sixth node to a first logic level in response to the voltage of the first node.

In example embodiments, the output circuit may include a first output circuit configured to control the emission control signal to a first logic level in response to the voltage of the first node, and a second output circuit configured to control the emission control signal to a second logic level in response to the voltage of the third node.

In example embodiments, each stage may further include a first holding circuit configured to maintain the voltage of the second node at the first logic level in response to the first clock signal, and a second holding circuit configured to maintain the voltage of the third node at the second logic level in response to the voltage of the first node.

In example embodiments, the second holding circuit may include a first holding transistor including a gate electrode connected to the first node, a first electrode configured to receive a second power voltage, and a second electrode connected to a seventh node, and a second holding transistor including a gate electrode connected to the first node, a first electrode connected to the seventh node, and a second electrode connected to the third node.

In example embodiments, each stage may further include a second leakage current blocking circuit configured to control a voltage of the seventh node to the first logic level in response to the voltage of the third node.

In example embodiments, the first output circuit may include a first output transistor including a gate electrode connected to the first node, a first electrode configured to receive a first power voltage, and a second electrode connected to an output terminal to which the emission control signal is output. The second output circuit may include a second output transistor including a gate electrode connected to the third node, a first electrode configured to receive a third power voltage, and a second electrode connected to the output terminal.

In example embodiments, the third power voltage may be higher than the second power voltage.

In example embodiments, a first width-to-length ratio of the first output transistor may be smaller than a second width-to-length ratio of the second output transistor.

In example embodiments, the voltage adjusting circuit may include a first voltage adjusting transistor including a gate electrode connected to the second node, a first electrode configured to receive a third clock signal, and a second electrode connected to a fifth node, a voltage adjusting capacitor including a first electrode connected to the second node and a second electrode connected to the fifth node, and a second voltage adjusting transistor including a gate electrode configured to receive the second clock signal, a first electrode connected to the fifth node, and a second electrode connected to the third node.

In example embodiments, a voltage of the third clock signal corresponding to a first logic level may be lower than a voltage of the second clock signal corresponding to the first logic level.

In example embodiments, the input circuit may include a first input circuit configured to apply the previous emission control signal or the vertical start signal to the first node in response to the first clock signal, and a second input circuit configured to apply the first clock signal to the second node in response to the voltage of the first node.

According to some example embodiments, an emission control driver may include a plurality of stages configured to output a plurality of emission control signals and a plurality of carry signals. Each stage may include an input circuit configured to receive a previous carry signal from one of previous stages or a vertical start signal, and configured to control a voltage of a first node and a voltage of a second node in response to a first clock signal; a stabilizing circuit configured to stabilize the voltage of the first node in response to the voltage of the second node and a second clock signal; a voltage adjusting circuit connected between the second node and a third node, the voltage adjusting circuit configured to boost the voltage of the second node, and configured to control the boosted voltage of the second node; an output circuit configured to control an emission control signal in response to the voltage of the first node and a voltage of the third node; and a carry output circuit configured to control a carry signal in response to the voltage of the first node and the voltage of the third node.

In example embodiments, the stabilizing circuit may include a first stabilizing transistor including a gate electrode connected to the second node, a first electrode configured to receive a second power voltage, and a second electrode connected to a sixth node, a second stabilizing transistor including a gate electrode connected to the second node, a first electrode connected to the sixth node, and a second electrode, and a third stabilizing transistor including a gate electrode configured to receive the second clock signal, a first electrode connected to the second electrode of the second stabilizing transistor, and a second electrode connected to the first node.

In example embodiments, each stage may further include a third leakage current blocking circuit configured to apply the carry signal to the sixth node in response to the carry signal.

In example embodiments, the output circuit may include a first output circuit configured to control the emission control signal to a first logic level in response to the voltage of the first node, and a second output circuit configured to control the emission control signal to a second logic level in response to the voltage of the third node. The second output circuit may include a third output transistor including a gate electrode connected to the third node, a first electrode receiving a second power voltage, and a second electrode connected to an eighth node, and a fourth output transistor including a gate electrode connected to the third node, a first electrode connected to the eighth node, and a second electrode connected to an output terminal to which the emission control signal is outputted.

In example embodiments, the carry output circuit may include a first carry output circuit configured to control the carry signal to the first logic level in response to the voltage of the first node, and a second carry output circuit configured to control the carry signal to the second logic level in response to the voltage of the third node.

In example embodiments, each stage may further include a third leakage current blocking circuit configured to apply the carry signal to the eighth node in response to the carry signal.

According to some example embodiments, a display device may include a display panel including a plurality of scan lines, a plurality of emission control lines, a plurality of data lines, and a plurality of pixels, a data driver configured to provide data signals to the pixels via the data lines, a scan driver configured to provide scan signals to the pixels via the scan lines, an emission control driver including a plurality of stages configured to output a plurality of emission control signals respectively, and configured to provide the emission control signals to the pixels via the emission control lines, and a controller configured to control the data driver, the scan driver, and the emission control driver. Each stage of the emission control driver may include an input circuit configured to receive a previous emission control signal from one of previous stages or a vertical start signal, and configured to control a voltage of a first node and a voltage of a second node in response to a first clock signal; a stabilizing circuit configured to stabilize the voltage of the first node in response to the voltage of the second node and a second clock signal; a voltage adjusting circuit connected between the second node and a third node, the voltage adjusting circuit configured to boost the voltage of the second node, and configured to control the boosted voltage of the second node; and an output circuit configured to control an emission control signal in response to the voltage of the first node and a voltage of the third node.

In example embodiments, the voltage adjusting circuit may include a first voltage adjusting transistor including a gate electrode connected to the second node, a first electrode configured to receive a third clock signal, and a second electrode connected to a fifth node, a voltage adjusting capacitor including a first electrode connected to the second node and a second electrode connected to the fifth node, and a second voltage adjusting transistor including a gate electrode configured to receive the second clock signal, a first electrode connected to the fifth node, and a second electrode connected to the third node.

In example embodiments, a voltage of the third clock signal corresponding to a first logic level may be lower than a voltage of the second clock signal corresponding to the first logic level.

In example embodiments, the controller may be configured to sense a magnitude of a current flowing through a power terminal of the emission control driver and to adjust a voltage of the third clock signal based on the sensed magnitude.

In example embodiments, each stage of the emission control driver may further include a load reducing circuit including a node capacitor having a first electrode configured to receive the first clock signal and a second electrode connected to the second node.

Therefore, an emission control driver according to example embodiments includes a voltage adjusting circuit controlling voltages of nodes in each stage to a high level voltage, thereby reducing the load of transistors. In the emission control driver, two transistors connected to each other in series are located in a part of each stage in which the leakage current occurs, and then the high level voltage is applied to the node between the two transistors, thereby preventing or reducing the leakage current. Accordingly, the emission control driver can stably maintain voltages of nodes in each stage and prevent abnormal pulses of the emission control signal caused by variation or deviation of threshold voltages of transistors.

In addition, a large-scale display device can be more stably driven by including the emission control driver of which reliability is improved.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Exemplary embodiments will be described more fully hereinafter with reference to the accompanying drawings, in which various embodiments are shown. The various drawings are not necessarily to scale. All numerical values are approximate, and may vary. All examples of specific materials and compositions are to be taken as nonlimiting and exemplary only. Other suitable materials and compositions may be used instead.

Figure 1:
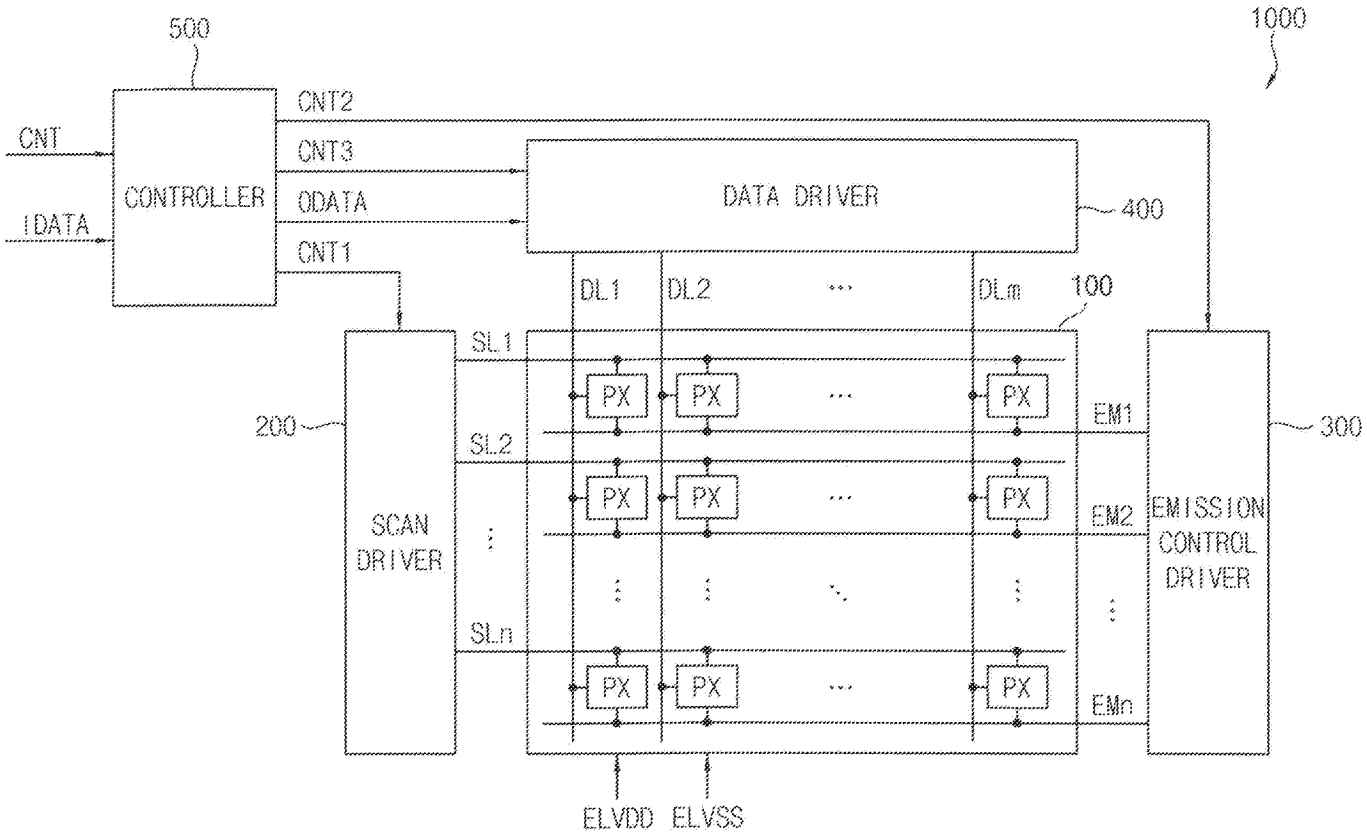
FIG. 1 is a block diagram illustrating a display device according to one example embodiment.

FIG. 1 is a block diagram illustrating a display device according to one example embodiment.

Referring to FIG. 1, the display device 1000 may include a display panel 100, a scan driver 200, an emission control driver 300, a data driver 400, and a controller 500.

The display panel 100 may display an image. The display panel 100 may include a plurality of scan lines SL1 through SLn, a plurality of data lines DL1 through DLm, a plurality of emission control lines EL1 through EMn, and a plurality of pixels PX. For example, the display panel 100 may include n*m pixels PX because the pixels PX are arranged at locations corresponding to crossing points of the scan lines SL1 through SLn and the data lines DL1 through DLm.

The scan driver 200 may provide scan signals to the pixels PX via the scan lines SL1 through SLn, based on a first control signal CNT1.

The emission control driver 300 may provide emission control signals to the pixels PX via the emission control lines EM1 through EMn, based on a second control signal CNT2. The emission control driver 300 may include a plurality of stages outputting the emission control signals, respectively.

Each stage of the emission control driver 300 may include a first input circuit, a second input circuit, a first output circuit, a stabilizing circuit, a voltage adjusting circuit, and a second output circuit. The voltage adjusting circuit of each stage may control the boosted voltage of a node to reduce load of the transistor in that stage. In one example embodiment, each stage of the emission control driver 300 may also include a load reducing circuit lowering the boosted voltage of the node. Also, in each stage of the emission control driver 300, two transistors connected to each other in series are located in a part of each stage in which the leakage current occurs, and then a high level voltage is applied between the two transistors to prevent or reduce the leakage current.

Therefore, the emission control driver 300 can prevent a change in threshold voltage of its transistors by reducing the load of these transistors, and can thus more stably output the emission control signal. Hereinafter, a structure of stage of the emission control driver 300 will be described in more detail with reference to the FIGS. 4, 6, 9, 11, 14, 16, 18, and 20.

The data driver 400 may receive a third control signal CTL3 and output image data ODATA. The data driver 400 may convert the output image data ODATA into analog type data signals and provide the data signals to the pixels PX via the data lines DL1 through DLm, based on the third control signal CTL3.

The controller 500 may control the scan driver 200, the emission control driver 300, and the data driver 400. The controller 500 may receive input image data IDATA and control signals CNT from a source outside of or external to the display device 1000 (e.g., a system board). The controller 500 may generate the first through third control signals CTL1 through CTL3 to control the scan driver 200, the emission control driver 400, and the data driver 500. More specifically, the first control signal CTL1 for controlling the scan driver 200 and the second control signal CTL2 for controlling the emission control driver 300 may respectively include a vertical start signal, clock signals, etc. The third control signal CTL3 for the controlling the data driver 400 may include a horizontal start signal, a load signal, etc. The controller 500 may generate output image data ODATA suitable to the operating conditions of the display panel 100 based on the input image data IDATA, and may provide the output image data ODATA to the data driver 400.

In one example embodiment, the controller 500 may sense a magnitude of a current flowing through a power terminal of the emission control driver 300, and may adjust a voltage level of the emission control clock signal provided to the emission control driver 300 based on the sensed current magnitude. For example, the controller 500 may determine the voltage of the emission control clock signal using a look-up table (LUT) in which a relationship between a magnitude of the current flowing through the power terminal and the voltage level of the emission control clock signal is stored. The controller 500 may adjust the voltage of the emission control clock signal in an embedded power management integrated circuit (PMIC), and provide the emission control clock signal to the emission control driver 300.

Figure 2:
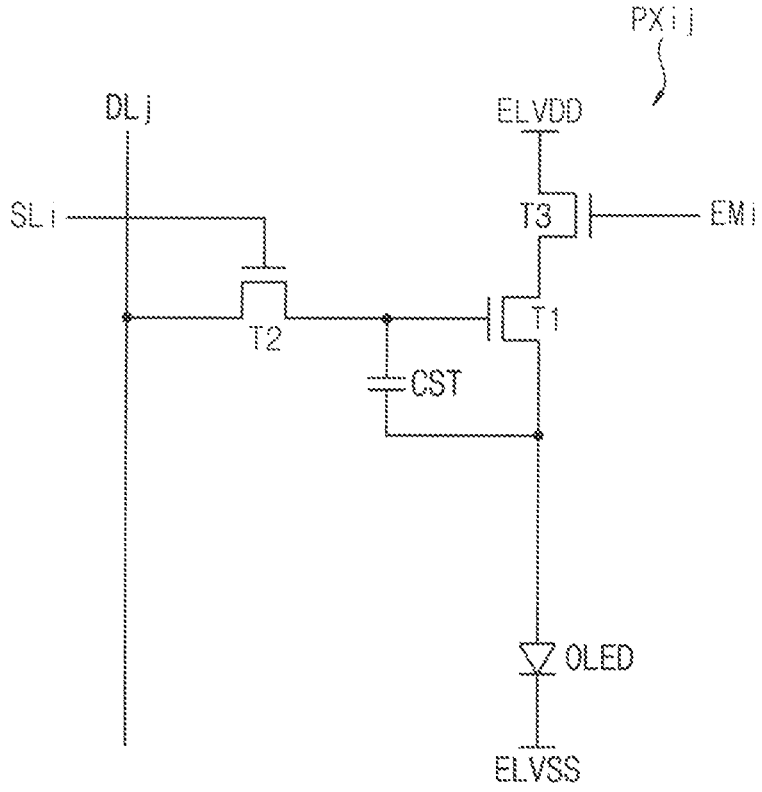
FIG. 2 is a circuit diagram illustrating an example of a pixel included in a display device of FIG. 1.

FIG. 2 is a circuit diagram illustrating an example of a pixel included in a display device of FIG. 1.

Referring to FIG. 2, the pixel PXij may include an organic light emitting diode OLED, a driving transistor T1, a capacitor CST, a switching transistor T2, and an emission control transistor T3.

The driving transistor T1 may include a gate electrode connected to a second electrode of the switching transistor T2, a first electrode connected to a second electrode of the emission control transistor T3, and a second electrode connected to a first electrode of the OLED.

The switch transistor T2 may include a gate electrode connected to a scan line SLi, a first electrode connected to a data line DLi, and a second electrode connected to the gate electrode of the driving transistor T1. The switching transistor T2 may thus provide a data signal to the gate electrode of the driving transistor T1 in response to a scan signal.

The capacitor CST may include a first electrode connected to the gate electrode of the driving transistor T1, and a second electrode connected to the second electrode of the driving transistor T1. The capacitor CST may charge the data signal applied to the gate electrode of the driving transistor T1 and may maintain the charged voltage of the gate electrode of the driving transistor T1 after the switch transistor T2 is turned-off.

The emission control transistor T3 may include a gate electrode connected to an emission control line EMi, a first electrode receiving a first emission voltage ELVDD, and a second electrode connected to a first electrode of the driving transistor T1. The emission control transistor T3 may therefore control the flow of the driving current flowing through the driving transistor T1, in response to an emission control signal from the emission control line EMi.

The OLED may include the first electrode connected to the second electrode of the driving transistor T1, and the second electrode receiving a second emission voltage ELVSS. The OLED may emit light based on the driving current.

Although, the example embodiment of FIG. 2 describes that the pixel PXij includes three transistors and one capacitor, the pixel PXij may be implemented in a variety of ways, with a variety of structures. For example, the pixel may further include transistors for initializing electrodes of the driving transistor and the capacitor in response to an initialization control signal.

Figure 3:
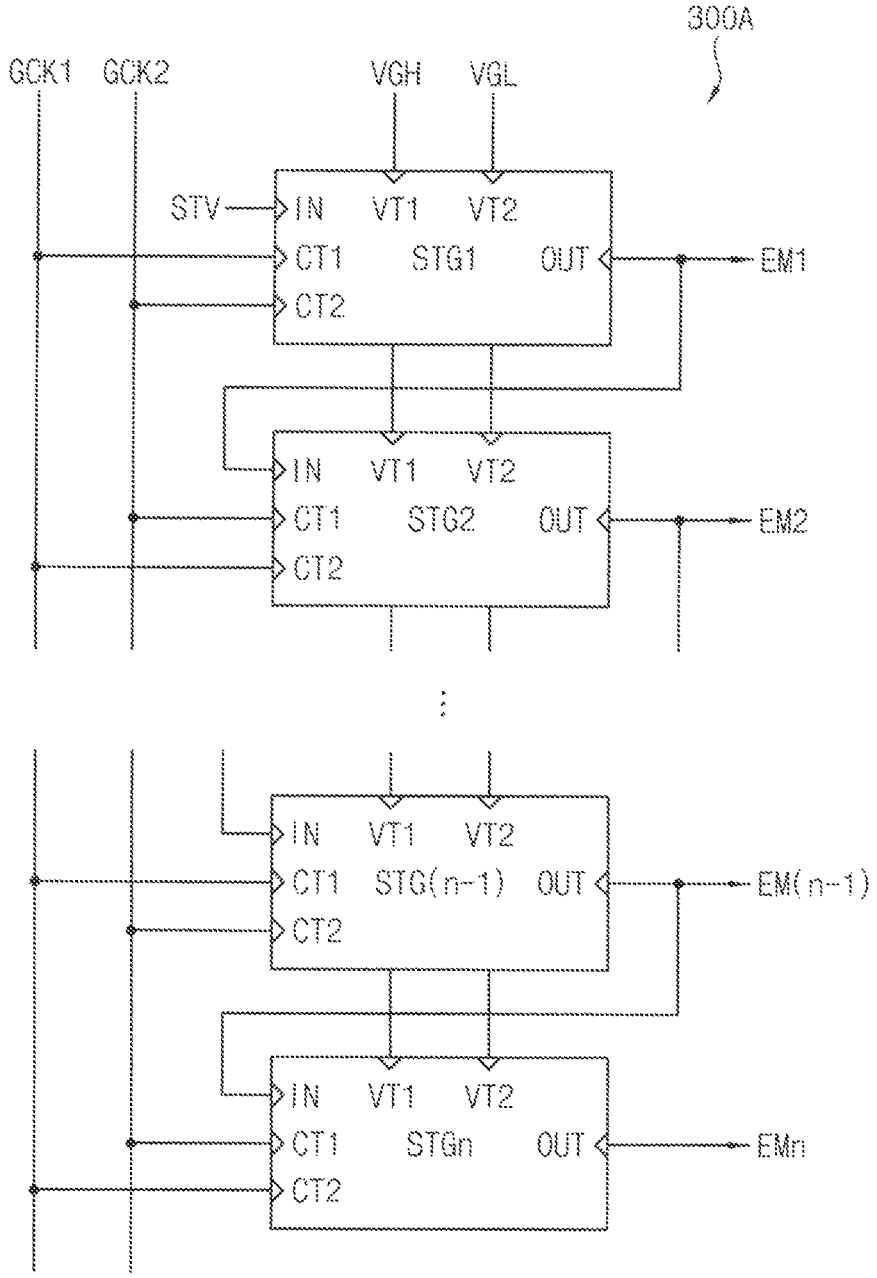
FIG. 3 is a block diagram illustrating one example of an emission control driver included in a display device of FIG. 1.

FIG. 3 is a block diagram illustrating one example of an emission control driver included in a display device of FIG. 1.

Referring to FIG. 3, the emission control driver 300A may include a plurality of stages STG1 through STGn. Each of the stages STG1 through STGn may output an emission control signal. Each of the stages STG1 through STGn may include an input terminal IN, a first clock terminal CT1, a second clock terminal CT2, a first power terminal VT1, a second power terminal VT2, and an output terminal OUT.

A first emission control clock signal GCK1 and a second emission control clock signal GCK2 having different timings may be applied to the first clock terminal CT1 and the second clock terminal CT2 of each stage. For example, the second emission control clock signal GCK2 may be a signal inverted from the first emission control clock signal GCK1. In adjacent stages, the first emission control clock signal GCK1 and the second emission control clock signal GCK2 may be applied in opposite sequences. For example, in the odd-numbered stages (e.g., STG1, STG3, etc), the first emission control clock signal GCK1 may be applied to the first clock terminal CT1 as the first clock signal, and the second emission control clock signal GCK2 may be applied to the second clock terminal CT2 as the second clock signal. In contrast, in the even-numbered stages (e.g., STG2, STG4, etc), the second emission control clock signal GCK2 may be applied to the first clock terminal CT1 as the first clock signal, and the first emission control clock signal GCK1 may be applied to the second clock terminal CT2 as the second clock signal.

A vertical start signal STV, or a previous emission control signal outputted from one of the previous stages, may be applied to the input terminal IN. For example, the vertical start signal STV is applied to the input terminal IN of the first stage STG1. The previous emission control signals may be respectively applied to each input terminal IN of immediately subsequent stages SRC2 through SRCn. The emission control signals may be outputted to the emission control lines via the output terminals OUT of the stages STG1 through STGn, respectively.

A first power voltage VGH corresponding to a first logic level may be provided to the first power terminals VT1 of the stages STG1 through STGn. For example, the first power voltage VGH may correspond to a high level voltage. A second power voltage VGL corresponding to a second logic level may be provided to the second power terminals VT2 of the stages STG1 through STGn. For example, the second power voltage VGL may correspond to a low level voltage.

Figure 4:
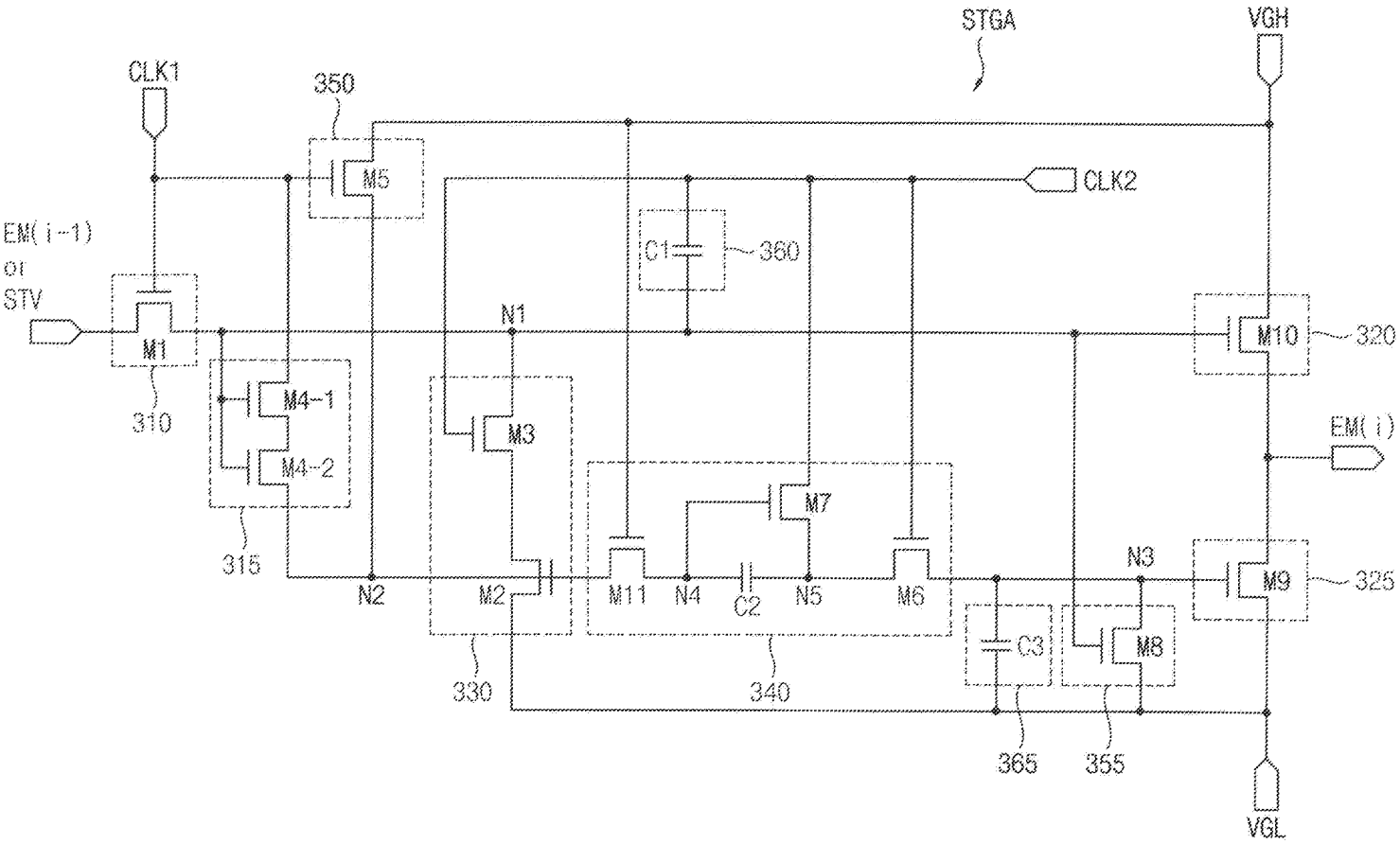
FIG. 4 is a circuit diagram illustrating one example of a stage included in an emission control driver of FIG. 3.

FIG. 4 is a circuit diagram illustrating one example of a stage included in an emission control driver of FIG. 3.

Referring to FIG. 4, a stage STGA of the emission control driver may include a first input circuit 310, a second input circuit 315, a first output circuit 320, a second output circuit 325, a stabilizing circuit 330, a voltage adjusting circuit 340, a first holding circuit 350, and a second holding circuit 355.

The first input circuit 310 may apply the previous emission control signal EM(i−1) or the vertical start signal STV to the first node N1 in response to the first clock signal CLK1. In one example embodiment, the first input circuit 310 may include a first input transistor M1. The first input transistor M1 may include a gate electrode connected to the first clock terminal, a first electrode connected to an input terminal, and a second electrode connected to the first node N1. Here, the first clock signal CLK1 applied to the first clock terminal corresponds to the first emission control clock signal GCK1 in odd-numbered stages and corresponds to the second emission control clock signal GCK2 in even-numbered stages.

The second input circuit 315 may apply the first clock signal CLK1 to the second node N2 in response to the voltage of the first node N1. In one example embodiment, the second input circuit 315 may include a second input transistor M4-1 and a third input transistor M4-2 that are connected to each other in series to reduce the leakage current and to reduce the load of transistors. The second input transistor M4-1 may include a gate electrode connected to the first node N1, a first electrode connected to the first clock terminal, and a second electrode connected to a first electrode of the third input transistor M4-2. The third input transistor M4-2 may include a gate electrode connected to the first node N1, a first electrode connected to the second electrode of the second input transistor M4-1, and a second electrode connected to the second node N2. When the voltage of the second node N2 corresponds to a high level voltage, the second input circuit 315 may reduce the leakage current flowing from the second node N2 to the first clock terminal.

The first output circuit 320 may control the emission control signal EM(i) to a first logic level in response to the voltage of the first node N1. In one example embodiment, the first output circuit 320 may include a first output transistor M10. The first output transistor M10 may include a gate electrode connected to the first node N1, a first electrode receiving a first power voltage VGH, and a second electrode connected to an output terminal to which the emission control signal EM(i) is outputted.

The second output circuit 325 may control the emission control signal EM(i) to a second logic level in response to the voltage of the third node N3. In one example embodiment, the second output circuit 325 may include a second output transistor M9. The second output transistor M9 may include a gate electrode connected to the third node N3, a first electrode receiving a second power voltage VGL, and a second electrode connected to the output terminal.

The stabilizing circuit 330 may stabilize the voltage of the first node N1 at the second logic level in response to the voltage of the second node N2 and a second clock signal CLK2. Accordingly, the emission control signal EM(i) can be stabilized. Here, the second clock signal CLK2 corresponds to the second emission control clock signal GCK2 in odd-numbered stages and corresponds to the first emission control clock signal GCK1 in even-numbered stages. The stabilizing circuit 330 may include a first stabilizing transistor M2 and a third stabilizing transistor M3 that are connected to each other in series. The first stabilizing transistor M2 may include a gate electrode connected to the second node N2, a first electrode receiving a second power voltage VGL, and a second electrode connected to a first electrode of the third stabilizing transistor M3. The third stabilizing transistor M3 may include a gate electrode receiving the second clock signal CLK2, a first electrode connected to the second electrode of the first stabilizing transistor M2, and a second electrode connected to the first node N1.

The voltage adjusting circuit 340 may be connected between the second node N2 and a third node N3, so as to boost the voltage of the second node N2 and control the boosted voltage of the second node N2. In one example embodiment, the voltage adjusting circuit 340 may include a node transistor M11, a first voltage adjusting transistor M7, a second voltage adjusting transistor M6, and a voltage adjusting capacitor C2. The node transistor M11 may include a gate electrode receiving a first power voltage VGH, a first electrode connected to the second node N2, and a second electrode connected to a fourth node N4. The node transistor M11 may be located between the second node N2 and the fourth node N4, of which voltage is boosted by the voltage adjusting capacitor C2, to lower the voltage of the second node N2. The first voltage adjusting transistor M7 may include a gate electrode connected to the fourth node N4, a first electrode receiving a second clock signal CLK2, and a second electrode connected to a fifth node N5. The voltage adjusting capacitor C2 may include a first electrode connected to the fourth node N4 and a second electrode connected to the fifth node N5. The second voltage adjusting transistor M6 may include a gate electrode receiving the second clock signal CLK2, a first electrode connected to the fifth node N5, and a second electrode connected to the third node N3.

The first holding circuit 350 may maintain the voltage of the second node N2 at the first logic level in response to the first clock signal CLK1. In one example embodiment, the first holding circuit 350 may include a third holding transistor M5. The third holding transistor M5 may include a gate electrode receiving the first clock signal CLK1, a first electrode receiving the first power voltage VGH, and a second electrode connected to the second node N2.

The second holding circuit 355 may maintain the voltage of the third node N3 at the second logic level in response to the voltage of the first node N1. In one example embodiment, the second holding circuit 355 may include a fourth holding transistor M8. The fourth holding transistor M8 may include a gate electrode connected to the first node N1, a first electrode receiving the second power voltage VGL, and a second electrode connected to the third node N3.

In addition, the stage STGA may further include a first capacitor 360 for maintaining a voltage of the gate electrode of the first output transistor M10 and a second capacitor 365 for maintaining a voltage of the gate electrode of the second output transistor M9.

Figure 5:
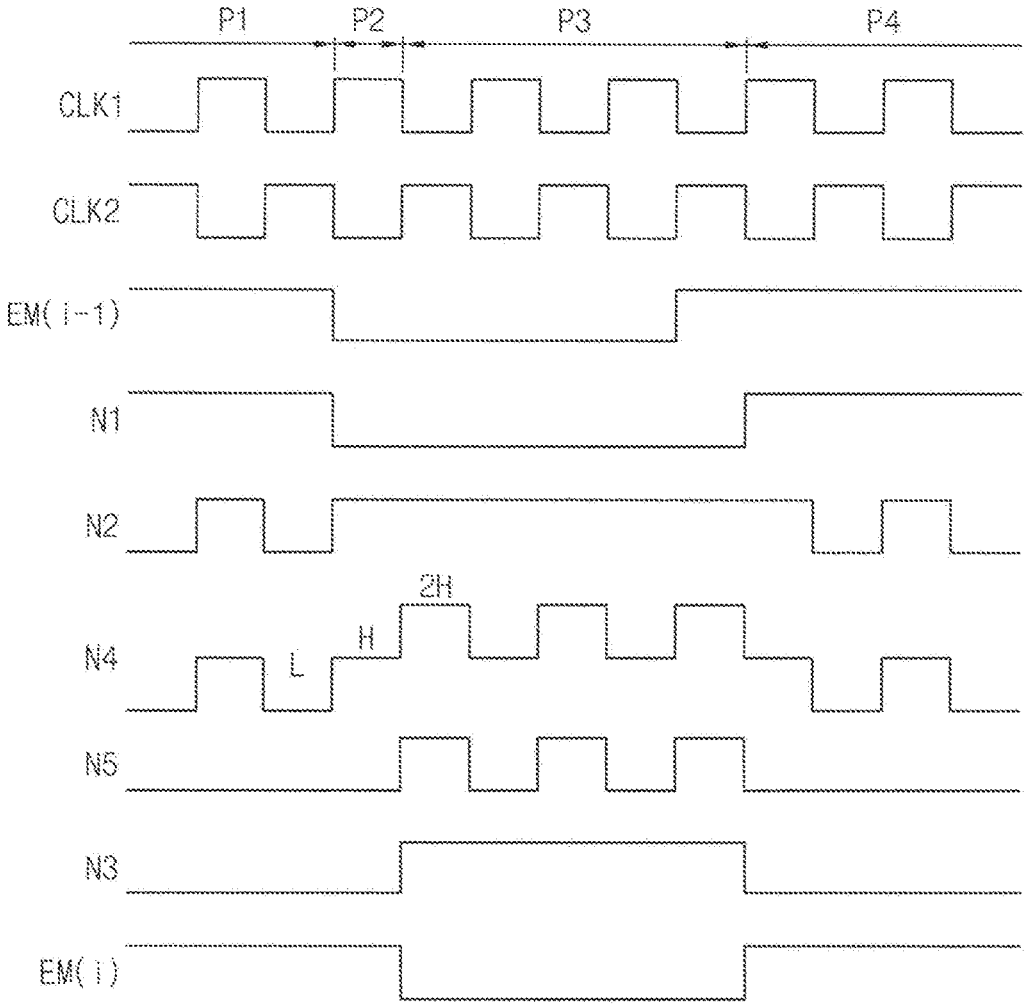
FIG. 5 is a timing diagram for describing an operation of a stage of FIG. 4.

FIG. 5 is a timing diagram for describing an operation of a stage of FIG. 4.

Referring to FIGS. 4 and 5, the node transistor M11 included in the voltage adjusting circuit 340 may be located between the second node N2 and the fourth node N4, to lower the voltage of the second node N2 and reduce the load of transistors (i.e., the first stabilizing transistor M2, the third holding transistor M5, the second input transistor M4-1, and the third input transistor M4-2) connected to the second node N2.

During the first period P1, a previous emission control signal EM(i−1) outputted from the previous stage may be at a high level. The first input circuit 310 may apply the previous emission control signal EM(i−1), set at its high level, to the first node N1 in response to the first clock signal CLK1. Accordingly, the voltage of the first node N1 may be set at a high level. Also, the emission control signal EM(i) may be maintained at a high level by the first output circuit 320.

During the second period P2, the previous emission control signal EM(i−1) may transition from its high level to a low level. The first input circuit 310 may apply the low level previous emission control signal EM(i−1) to the first node N1 in response to the clock signal CLK1. Accordingly, the voltage of the node N1 may be set at the low level. The voltages of the second node N2 and the fourth node N4 may be set to a high level by the first holding transistor 350. Because the first voltage adjusting transistor M7 applies the low-level second clock signal CLK2 to the fifth node N5, the voltage of the fifth node N5 may be set at a low level. Because the second voltage adjusting transistor M6 is turned off by the low level of the second clock signal CLK2, the voltage of the third node N3 may be set at a low level. As a result, the second output transistor M9 may be turned off and the emission control signal EM(i) may be maintained at a high level.

During the third period P3, the second clock signal CLK2 may transition from high level to low level, and thereafter from low level to high level again. Therefore, the voltage of the fourth node N4 is boot-strapped by a variation of electric potential of the second clock signal CLK2, due to the coupling of the voltage adjusting capacitor C2. At this time, the voltage of the fourth node N4 corresponds to the boosted high level. However, because high level voltage is applied to the gate electrode of the node transistor M11 and boosted high level voltage is applied to the second electrode of the node transistor M11, the voltage of the second node N2 may not increase. After this, when the second clock signal CLK2 transits from high level to low level, the boosted voltage of the fourth node N4 may decrease because the first adjusting transistor M7 applies the second clock signal CLK2 to the fifth node N5. The voltage of the third node N3 may be high level because the second voltage adjusting transistor M6 applies the voltage of the fifth node N5 to the third node N3 in response to the second clock signal CLK2. Accordingly, the second output transistor M9 may apply the second power voltage VGL to the output terminal, and thus the emission control signal EM(i) may be maintained at a low level during the third period P3.

During the third period P4, the voltage of the first node N1 is maintained at a high level and the voltage of the third node N3 is maintained at a low level. Therefore, the emission control signal EM(i) may be maintained at a high level.

Figure 6:
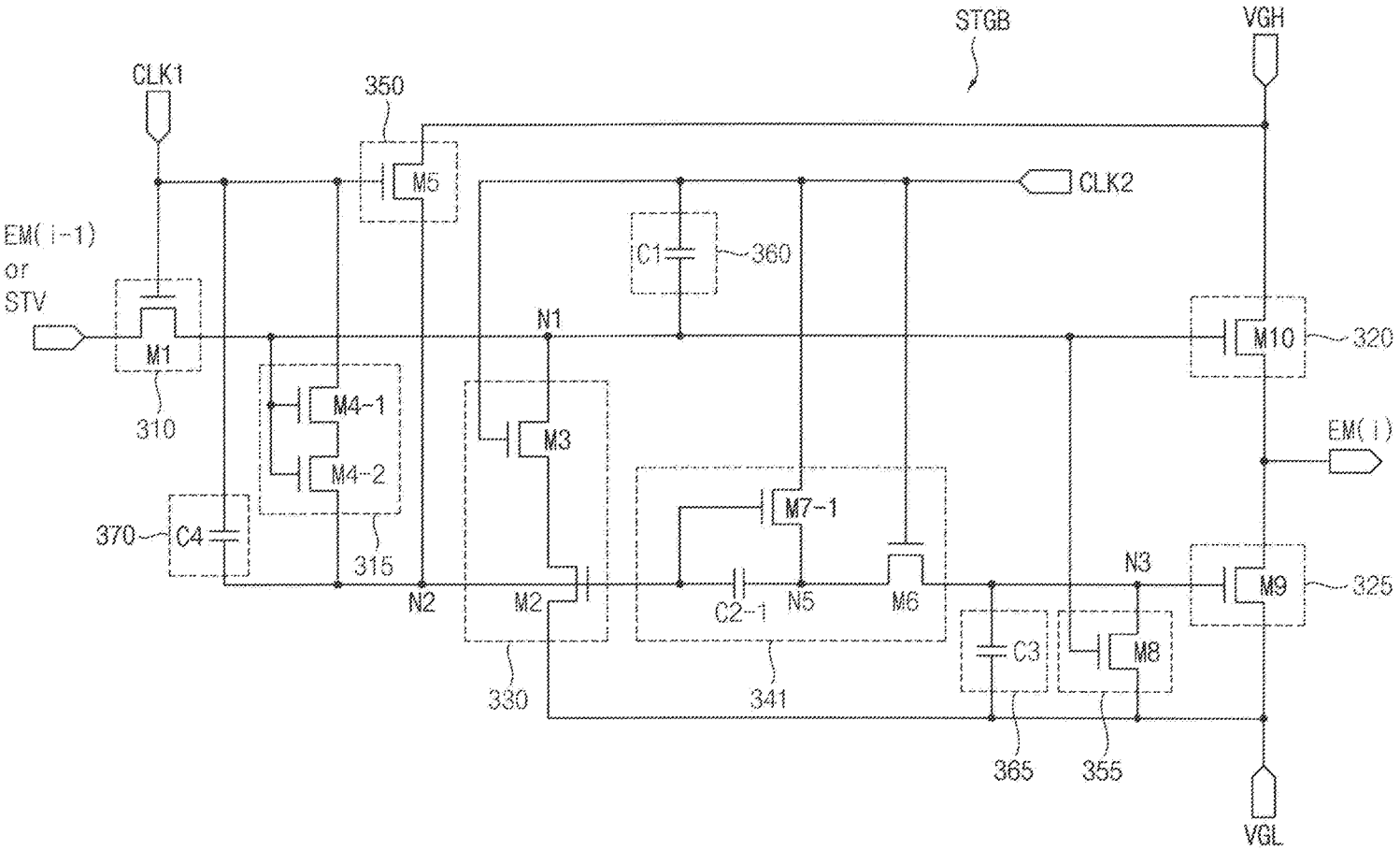
FIG. 6 is a circuit diagram illustrating another example of a stage included in an emission control driver of FIG. 3.

FIG. 6 is a circuit diagram illustrating another example of a stage included in an emission control driver of FIG. 3.

Referring to FIG. 6, a stage STGB of the emission control driver may include a first input circuit 310, a second input circuit 315, a first output circuit 320, a second output circuit 325, a stabilizing circuit 330, a voltage adjusting circuit 341, a first holding circuit 350, a second holding circuit 355, and a load reducing circuit 370. The stage STGB according to the present exemplary embodiment is substantially the same as the stage of the exemplary embodiment described in FIG. 4, except that the load reducing circuit 370 is added (with corresponding omission of transistor M11). Therefore, the same reference numerals will be used to refer to the same or like parts as those described in the previous exemplary embodiment of FIG. 4 and any repetitive explanation concerning the above elements will be omitted.

The voltage adjusting circuit 341 may be connected between a second node N2 and a third node N3, to boost the voltage of the second node N2 and control the boosted voltage of the second node N2. In one example embodiment, the voltage adjusting circuit 341 may include a first voltage adjusting transistor M7-1, a second voltage adjusting transistor M6, and a voltage adjusting capacitor C2-1. The first voltage adjusting transistor M7-1 may include a gate electrode connected to the second node N2, a first electrode receiving a second clock signal CLK2, and a second electrode connected to a fifth node N5. The voltage adjusting capacitor C2-1 may include a first electrode connected to the second node N2 and a second electrode connected to the fifth node N5. The second voltage adjusting transistor M6 may include a gate electrode receiving the second clock signal CLK2, a first electrode connected to the fifth node N5, and a second electrode connected to the third node N3.

The load reducing circuit 370 may reduce a load of the second node N2. The load reducing circuit 370 may include a node capacitor C4. The node capacitor C4 may include a first electrode receiving the first clock signal CLK1, and a second electrode connected to the second node N2. In a circuit including capacitors in series, voltage drop across each capacitor may be different depending upon the capacitance of each capacitor. Therefore, the magnitude of the boosted voltage of the second node N2 may be determined by a ratio of a capacitance of the node capacitor C4 to a capacitance of the voltage adjusting capacitor C2-1.

Figure 7:
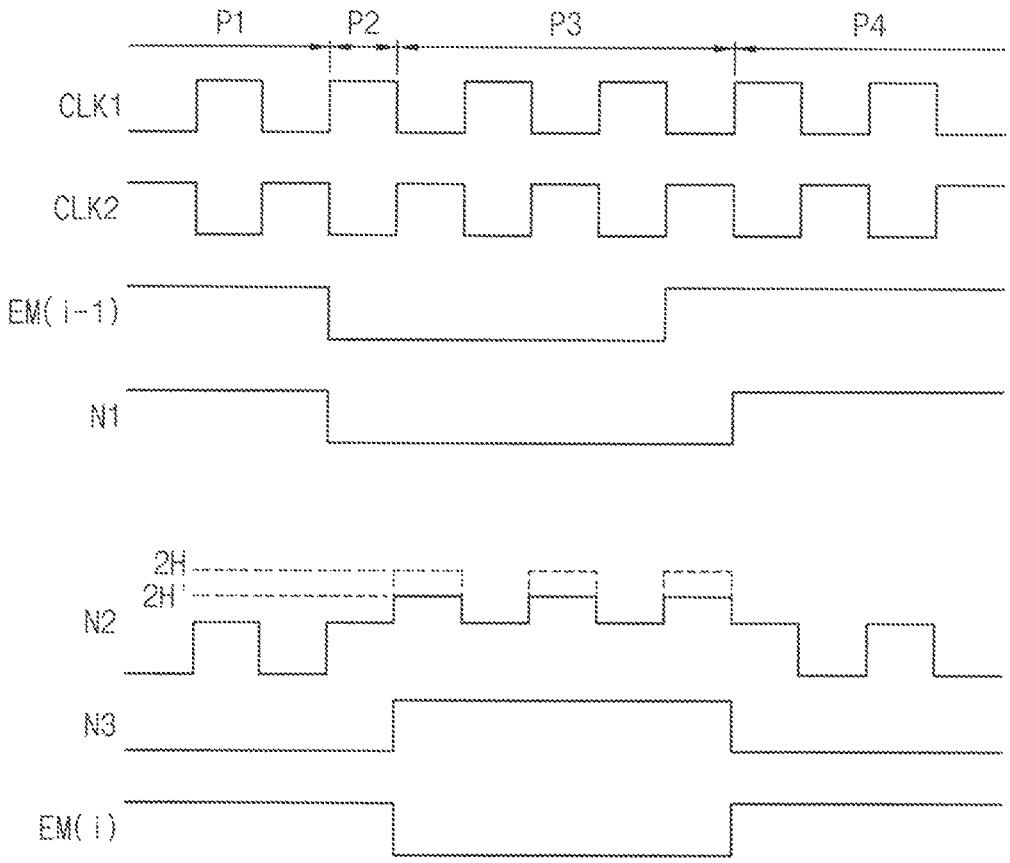
FIG. 7 is a timing diagram for describing an operation of a stage of FIG. 6.

FIG. 7 is a timing diagram for describing an operation of a stage of FIG. 6.

Referring to FIGS. 6 and 7, the node capacitor C4 in the load reducing circuit 370 may lower the voltage of the second node N2, thereby reducing the load of transistors (i.e., the first stabilizing transistor M2, the third holding transistor M5, the second input transistor M4-1, and the third input transistor M4-2) connected to the second node N2. The operation of the stage STGB according to the present exemplary embodiment is substantially the same as the operation of the stage of the exemplary embodiment described in FIG. 5, except that the boosted voltage is applied to the second node by the voltage adjusting capacitor because the stage does not include the node transistor. Therefore, the same reference numerals will be used to refer to the same or like parts as those described in the previous exemplary embodiment of FIG. 5 and any repetitive explanation concerning the above elements will be omitted.

The high level voltages of the first and second clock signals CLK1 and CLK2 and the first power voltage VGH were set to 38V, and the low level voltages of the first and second clock signals CLK1 and CLK2 and the second power voltage VGL were set to −2V. In this case, the boosted voltage applied to the second node N2 decreased from the first boosted voltage 2H to the second boosted voltage 2H' according to the ratio of capacitance of the node capacitor C4 to the capacitance of the voltage adjusting capacitor C2-1. Specifically, in the case that the stage does not include the node capacitor C4, the first boosted voltage 2H applied to the second node N2 was measured at 72V. On the other hand, in case that the capacitance of the node capacitor C4 equals the capacitance of the voltage adjusting capacitor C2-1, the second boosted voltage 2H' applied to the second node N2 was measured at 50.1V. In case that the capacitance of the node capacitor C4 is twice the capacitance of the voltage adjusting capacitor C2-1, the second boosted voltage 2H' applied to the second node N2 was measured at 42.1V. [TABLE 1] indicates a relation between the ratio of the capacitance of the node capacitor C4 to the capacitance of the voltage adjusting capacitor C2-1 and the boosted voltage of the second node.

TABLE 1

| RATIO(C4/C2) | 2H' |
|---|---|
| 0.2 | 58.9 |
| 1 | 50.1 |

TABLE 1-continued

| RATIO(C4/C2) | 2H' |
|---|---|
| 1.5 | 45.8 |
| 2 | 42.1 |

Therefore, the node capacitor C4 can be implemented to have appropriate size/capacitance in consideration of the boosted voltage of the second node N2. For example, the boosted voltage of the second node N2 may be determined such that the stabilizing circuit normally operates when the voltage of the first node N1 corresponds to a low level, so as to substantially eliminate ripple in the emission control signal EM(i). In addition, the boosted voltage applied to the second node N2 may be determined such that loads of the transistors connected to the second node N2 are sufficiently small.

Figure 8:
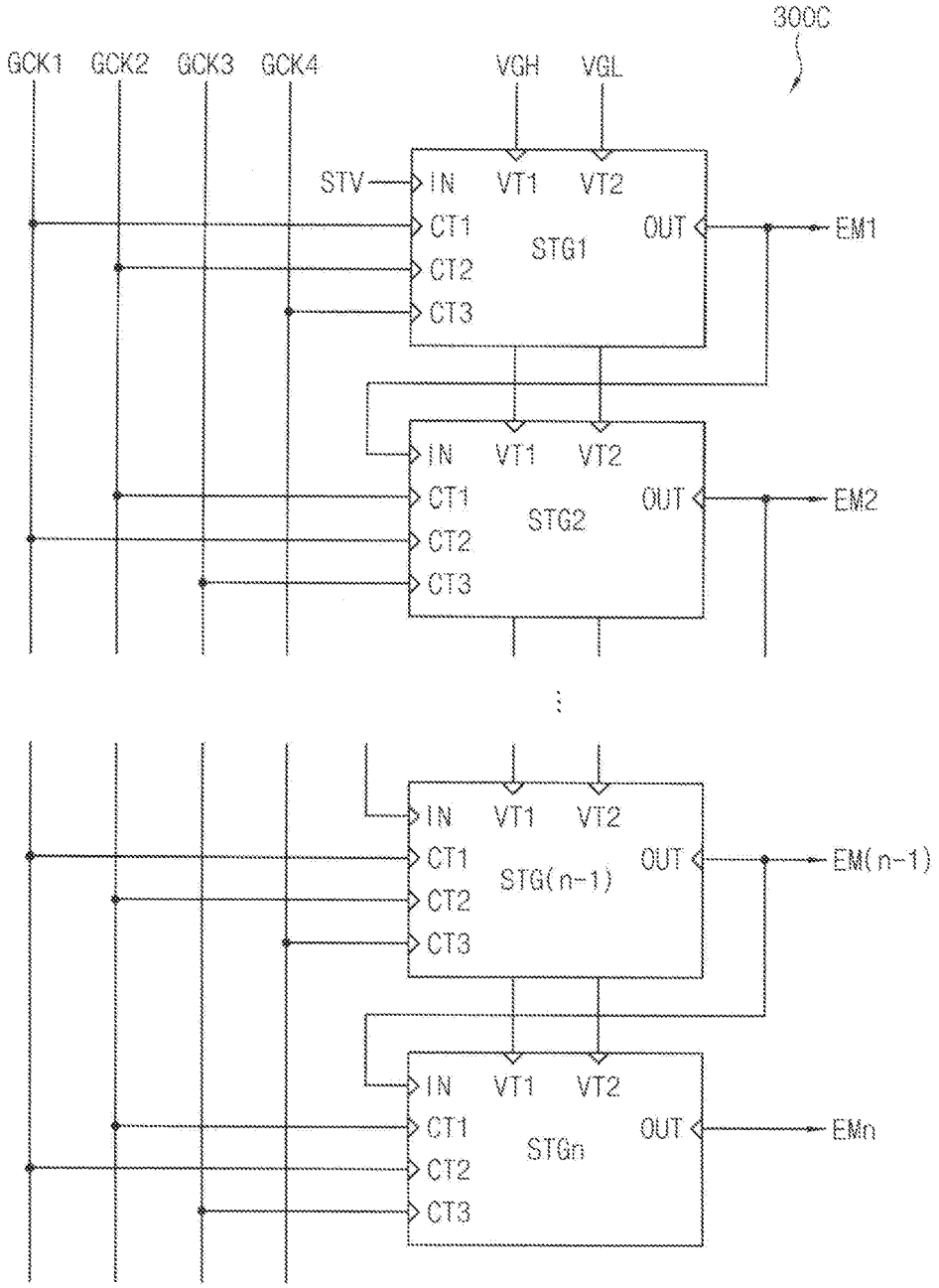
FIG. 8 is a block diagram illustrating another example of an emission control driver included in a display device of FIG. 1.

FIG. 8 is a block diagram illustrating another example of an emission control driver included in a display device of FIG. 1.

Referring to FIG. 8, the emission control driver 300C may include a plurality of stages STG1 through STGn. Each of the stages STG1 through STGn may output an emission control signal. Each of the stages STG1 through STGn may include an input terminal IN, a first clock terminal CT1, a second clock terminal CT2, a third clock terminal CT3, a first power terminal VT1, a second power terminal VT2, and an output terminal OUT. The emission control driver 300C according to the present exemplary embodiment is substantially the same as the driver 300A of the exemplary embodiment described in FIG. 3, except that the third clock terminal CT3 is added. Therefore, the same reference numerals will be used to refer to the same or like parts as those described in the previous exemplary embodiment of FIG. 3, and any repetitive explanation concerning the above elements will be omitted.

A first emission control clock signal GCK1 and a second emission control clock signal GCK2 having different timings may be applied to the first clock terminal CT1 and the second clock terminal CT2 of each stage. For example, the second emission control clock signal GCK2 may be a signal inverted from the first emission control clock signal GCK1. In adjacent stages, the first emission control clock signal GCK1 and the second emission control clock signal GCK2 may be applied in opposite sequences. For example, in the odd-numbered stages (e.g., STG1, STG3, etc), the first emission control clock signal GCK1 may be applied to the first clock terminal CT1 as the first clock signal, and the second emission control clock signal GCK2 may be applied to the second clock terminal CT2 as the second clock signal. In contrast, in the even-numbered stages (e.g., STG2, STG4, etc), the second emission control clock signal GCK2 may be applied to the first clock terminal CT1 as the first clock signal, and the first emission control clock signal GCK1 may be applied to the second clock terminal CT2 as the second clock signal.

One of a third emission control signal GCK3 and a fourth emission control clock signal GCK4 having different timings may be applied to the third clock terminal CT3 of each stage. A waveform of the third emission control clock signal GCK3 may be substantially the same as a waveform of the first emission control clock signal GCK1. A high level voltage of the third emission control clock signal GCK3 may be lower than a high level voltage of the first emission control clock signal GCK1. A waveform of the fourth emission control clock signal GCK4 may be substantially the same as a waveform of the second emission control clock signal GCK2. A high level voltage of the fourth emission control clock signal GCK4 may be lower than a high level voltage of the second emission control clock signal GCK2. Further, in the odd-numbered stages (e.g., STG1, STG3, etc), the fourth emission control clock signal GCK4 may be applied to the third clock terminal CT3 as the third clock signal. In contrast, in the even-numbered stages (e.g., STG2, STG4, etc), the third emission control clock signal GCK3 may be applied to the third clock terminal CT3 as the third clock signal.

Figure 9:
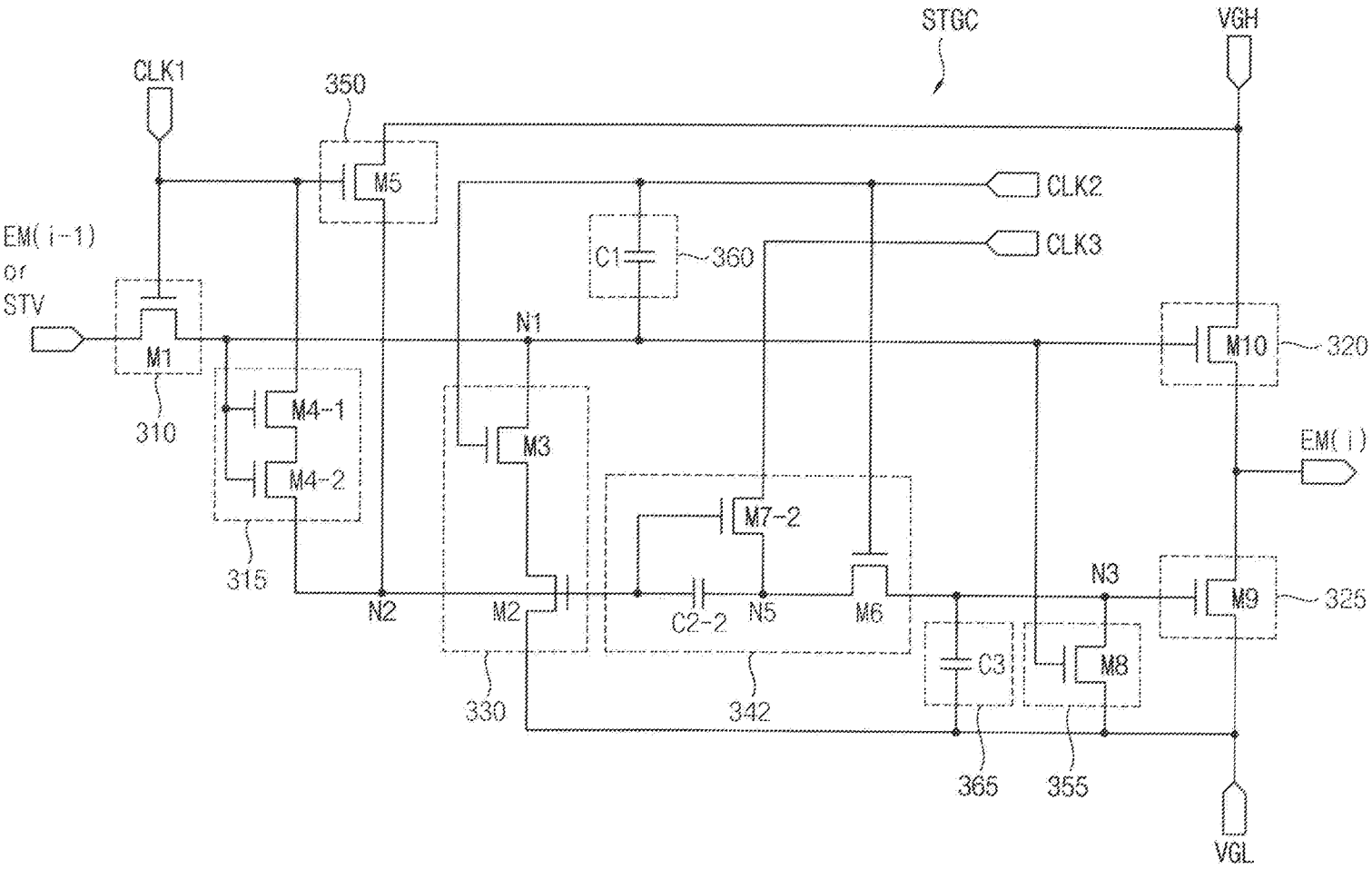
FIG. 9 is a circuit diagram illustrating one example of a stage included in an emission control driver of FIG. 8.

FIG. 9 is a circuit diagram illustrating one example of a stage included in an emission control driver of FIG. 8.

Referring to FIG. 9, a stage STGC of the emission control driver 300C may include a first input circuit 310, a second input circuit 315, a first output circuit 320, a second output circuit 325, a stabilizing circuit 330, a voltage adjusting circuit 342, a first holding circuit 350, and a second holding circuit 355. The stage STGC according to the present exemplary embodiment is substantially the same as the stage STGA of the exemplary embodiment described in FIG. 4, except that a first voltage adjusting transistor M7-2 included in the voltage adjusting circuit 342 is connected to the third clock terminal. Therefore, the same reference numerals will be used to refer to the same or like parts as those described in the previous exemplary embodiment of FIG. 4 and any repetitive explanation concerning the above elements will be omitted.

The voltage adjusting circuit 342 may be connected between a second node N2 and a third node N3, to thereby boost the voltage of the second node N2 and control the boosted voltage of the second node N2. In one example embodiment, the voltage adjusting circuit 342 may include a first voltage adjusting transistor M7-2, a second voltage adjusting transistor M6, and a voltage adjusting capacitor C2-2. The first voltage adjusting transistor M7-2 may include a gate electrode connected to the second node N2, a first electrode receiving a third clock signal CLK3, and a second electrode connected to a fifth node N5. The voltage adjusting capacitor C2-1 may include a first electrode connected to the second node N2 and a second electrode connected to the fifth node N5. The second voltage adjusting transistor M6 may include a gate electrode receiving the second clock signal CLK2, a first electrode connected to the fifth node N5, and a second electrode connected to the third node N3. A waveform of the third clock signal CLK3 may be substantially the same as a waveform of the second clock signal CLK2. A high level voltage of the third clock signal CLK3 may be lower than a high level voltage of the second clock signal CLK2.

The voltage of the second node N2 may be boot-strapped by a variation of electric potential of the third clock signal CLK3, due to the coupling of the voltage adjusting capacitor C2-2. Therefore, the boosted voltage level of the second node N2 can be adjusted by the voltage level of the third clock signal CLK3.

In one example embodiment, a magnitude of a current flowing through a second power terminal of an emission control driver may be sensed, and the voltage of the third clock signal CLK3 may be adjusted based on the magnitude of the current. Characteristics (e.g., threshold voltages) of transistors included in the stage may vary as time passes, changing the magnitude of the current flowing through the power terminal. Therefore, the voltage of the third clock signal CLK3 may be adjusted based on the magnitude of the sensed current, so as to improve a reliability of the stage. For example, if the magnitude of the sensed current is relatively large, the voltage of the third clock signal CLK3 may be set to a relatively low voltage because the threshold voltage of the transistor has dropped. On the other hand, if the magnitude of the sensed current is relatively small, the voltage of the third clock signal CLK3 may be set to a relatively high voltage because the threshold voltage of the transistor has increased.

Although the example embodiment of FIG. 9 describes that the voltage adjusting circuit includes the first voltage adjusting transistor, the second voltage adjusting transistor, and the voltage adjusting capacitor, the voltage adjusting circuit further includes the node transistor.

Figure 10:
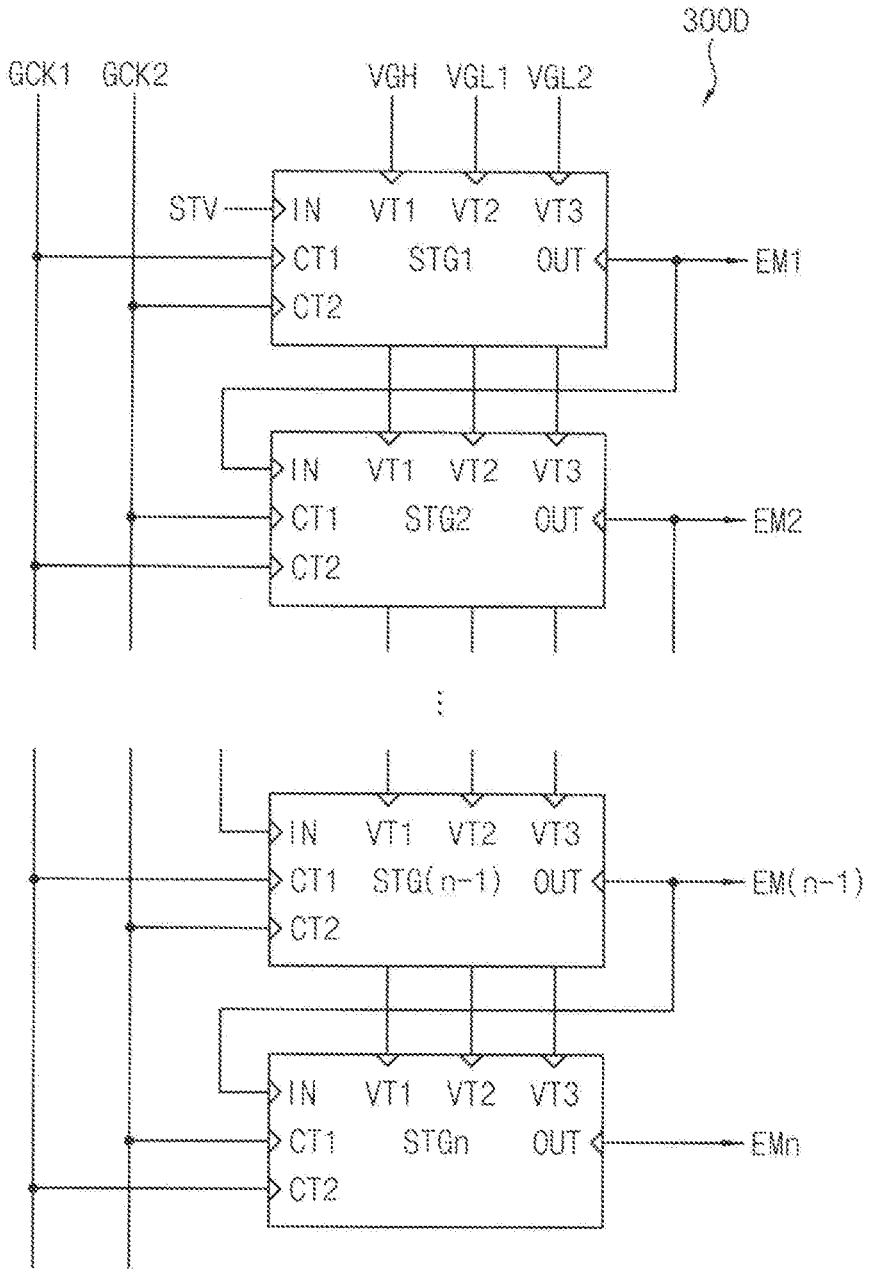
FIG. 10 is a block diagram illustrating still another example of an emission control driver included in a display device of FIG. 1.

FIG. 10 is a block diagram illustrating still another example of an emission control driver included in a display device of FIG. 1.

Referring to FIG. 10, the emission control driver 300D may include a plurality of stages STG1 through STGn. Each of the stages STG1 through STGn may output an emission control signal. Each of the stages STG1 through STGn may include an input terminal IN, a first clock terminal CT1, a second clock terminal CT2, a first power terminal VT1, a second power terminal VT2, a third power terminal VT3, and an output terminal OUT. The emission control driver 300D according to the present exemplary embodiment is substantially the same as the driver 300A of the exemplary embodiment described in FIG. 3, except that the third power terminal VT3 is added to each stage. Therefore, the same reference numerals will be used to refer to the same or like parts as those described in the previous exemplary embodiment of FIG. 3, and any repetitive explanation concerning the above elements will be omitted.

A first power voltage VGH corresponding to a first logic level may be provided to the first power terminals VT1 of the stages STG1 through STGn. For example, the first power voltage VGH may correspond to a high level voltage. A second power voltage VGL1 corresponding to a second logic level may be provided to the second power terminals VT2 of the stages STG1 through STGn. For example, the second power voltage VGL1 may correspond to a first low level voltage. A third power voltage VGL2 corresponding to the second logic level may be provided to the third power terminals VT3 of the stages STG1 through STGn. For example, the third power voltage VGL2 may correspond to a second low level higher than the first low level.

Figure 11:
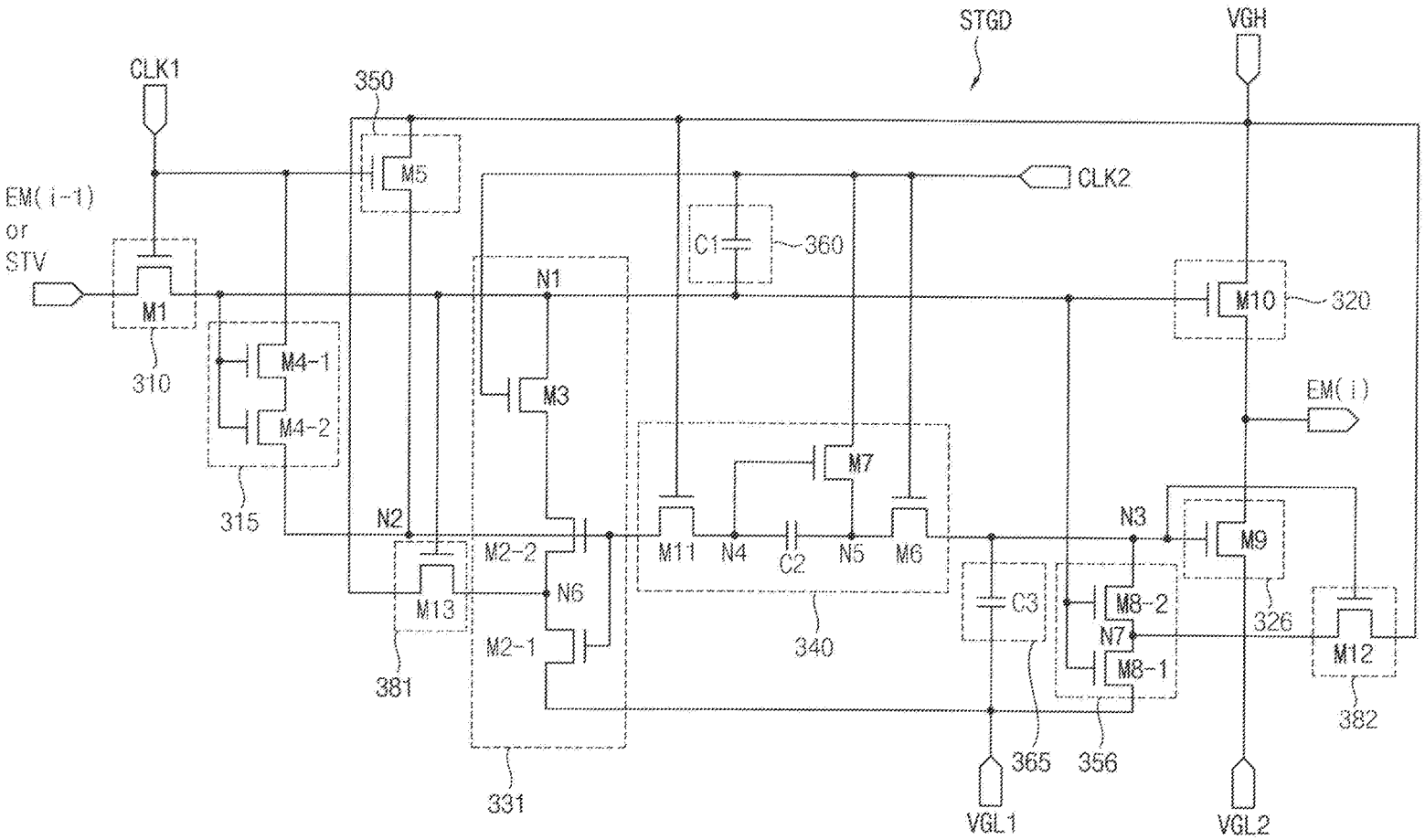
FIG. 11 is a circuit diagram illustrating one example of a stage included in an emission control driver of FIG. 10.

FIG. 11 is a circuit diagram illustrating one example of a stage included in an emission control driver of FIG. 10.

Referring to FIG. 11, a stage STGD of the emission control driver 300D may include a first input circuit 310, a second input circuit 315, a first output circuit 320, a second output circuit 326, a stabilizing circuit 331, a voltage adjusting circuit 340, a first holding circuit 350, a second holding circuit 356, a first leakage current blocking circuit 381, and a second leakage current blocking circuit 382. The first input circuit 310, the second input circuit 315, the voltage adjusting circuit 340, and the first holding circuit 350 according to the present exemplary embodiment are substantially the same as the first input circuit, the second input circuit, the voltage adjusting circuit, and the first holding circuit of the exemplary embodiment described in FIG. 4. Therefore, the same reference numerals will be used to refer to the same or like parts as those described in the previous exemplary embodiment of FIG. 4, and any repetitive explanation concerning the above elements will be omitted.

The first output circuit 320 may control the emission control signal EM(i) to a first logic level in response to the voltage of the first node N1. In one example embodiment, the first output circuit 320 may include a first output transistor M10. The first output transistor M10 may include a gate electrode connected to the first node N1, a first electrode receiving a first power voltage VGH, and a second electrode connected to an output terminal to which the emission control signal EM(i) is outputted.

The second output circuit 326 may control the emission control signal EM(i) to a second logic level in response to the voltage of the third node N3. In one example embodiment, the second output circuit 326 may include a second output transistor M9. The second output transistor M9 may include a gate electrode connected to the third node N3, a first electrode receiving a third power voltage VGL2, and a second electrode connected to the output terminal.

The stage STGD may receive the second and third power voltages VGL1 and VGL2 that both correspond to the second logic level, so as to prevent leakage current. In one example embodiment, the third power voltage VGL2 may be higher than the second power voltage VGL1. The stabilizing circuit 331 and the second holding circuit 356 may set the voltages of the first and third nodes N1 and N3 to the second power voltage VGL1. In contrast, the second output circuit 326 may set the emission control signal EM(i) to the third power voltage VGL2. Accordingly, when the second power voltage VGL1 (i.e., the first low level voltage) is applied to the gate electrode of the first output transistor M10, the third power voltage VGL2 (i.e., the second low level voltage) higher than the second power voltage VGL1 is applied to the second electrode of the first output transistor M10. Therefore, the leakage current flowing from the first electrode to the second electrode of the first output transistor M10 can be reduced. In addition, when the second power voltage VGL1 is applied to the gate electrode of the second output transistor M9, the third power voltage VGL2 greater than the second power voltage VGL1 is applied to the first electrode of the second output transistor M9. Therefore, the leakage current flowing from the second electrode to the first electrode of the second output transistor M9 can be reduced.

In one example embodiment, a first width-to-length ratio of the first output transistor M10 may be smaller than a second width-to-length ratio of the second output transistor M9. The second power voltage VGL1 may be applied to the stabilizing circuit 331 and the second holding circuit 356, and the third power voltage VGL2 may be applied to the second output circuit 326 to prevent or reduce the leakage current flowing through the first output transistor M10. Accordingly, the first output transistor M10 can be implemented in small size. For example, the first width-to-length ratio of the first output transistor M10 may be equal to or less than 30% of the second width-to-length ratio of the second output transistor M9. More specifically, a width of the first output transistor M10 may be about 120 micrometers, and a width of the second output transistor M9 may be about 450 micrometers.

The stabilizing circuit 331 may stabilize the emission control signal EM(i) in response to the voltage of the second node N2 and a second clock signal CLK2. In one example embodiment, the stabilizing circuit 331 may include a first stabilizing transistor M2-1, a second stabilizing transistor M2-2, and a third stabilizing transistor M3. The first stabilizing transistor M2-1 may include a gate electrode connected to the second node N2, a first electrode receiving a second power voltage VGL1, and a second electrode connected to the sixth node N6. The second stabilizing transistor M2-2 may include a gate electrode connected to the second node N2, a first electrode connected to the sixth node N6, and a second electrode. The third stabilizing transistor M3 may include a gate electrode receiving the second clock signal CLK2, a first electrode connected to the second electrode of the second stabilizing transistor M2-2, and a second electrode connected to the first node N1.

The first leakage current blocking circuit 381 may control a voltage of the sixth node N6 to a first logic level in response to the voltage of the first node N1. In one example embodiment, the first leakage current blocking circuit 381 may include a first blocking transistor M13. The first blocking transistor M13 may include a gate electrode connected to the first node N1, a first electrode receiving the first power voltage VGH, and a second electrode connected to the sixth node N6.

From the above, the stabilizing circuit 331 includes a plurality of transistors that are connected to each other in series. Accordingly, when the voltage of the first node N1 corresponds to a high level voltage, the stabilizing circuit 331 may reduce the leakage current flowing from the first node N1 to the second power terminal to which the second power voltage VGL1 is provided. In addition, when the voltage of the first node N1 corresponds to a high level voltage, the first leakage current blocking circuit 381 may set the voltage of the sixth node N6 to the high level voltage to prevent the leakage current flowing from the first node N1 to the second power terminal.

The second holding circuit 356 may maintain the voltage of the third node N3 as the second logic level in response to the voltage of the first node N1. In one example embodiment, the second holding circuit 356 may include a first holding transistor M8-1 and a second holding transistor M8-2. The first holding transistor M8-1 may include a gate electrode connected to the first node N1, a first electrode receiving a second power voltage VGL1, and a second electrode connected to a seventh node N7. The second holding transistor M8-2 may include a gate electrode connected to the first node N1, a first electrode connected to the seventh node N7, and a second electrode connected to the third node N3.

The second leakage current blocking circuit 382 may control a voltage of the seventh node N7 to the first logic level in response to the voltage of the third node N3. In one example embodiment, the second leakage current blocking circuit 382 may include a second blocking transistor M12. The second blocking transistor M12 may include a gate electrode connected to the third node N3, a first electrode receiving the first power voltage VGH, and a second electrode connected to the seventh node N7.

As can be seen, the second holding circuit 356 includes a plurality of transistors that are connected to each other in series. Accordingly, when the voltage of the third node N3 corresponds to a high level voltage, the second holding circuit 356 may reduce the leakage current flowing from the third node N3 to the second power terminal to which the second power voltage VGL1 is provided. In addition, when the voltage of the third node N3 corresponds to a high level voltage, the second leakage current blocking circuit 382 may set the voltage of the seventh node N7 in the second holding circuit 356 to the high level voltage to prevent the leakage current flowing from the third node N3 to the second power terminal.

Although the example embodiments of FIG. 11 describe that the leakage current blocking circuits apply high level voltage to the stabilizing circuit or/and the holding circuit, embodiments are not limited thereto. For example, each part of the stage in which the leakage current occurs may include two transistors connected to each other in series, where the leakage current blocking circuits apply high level voltage to the node between two transistors in each part.

Figure 12A:
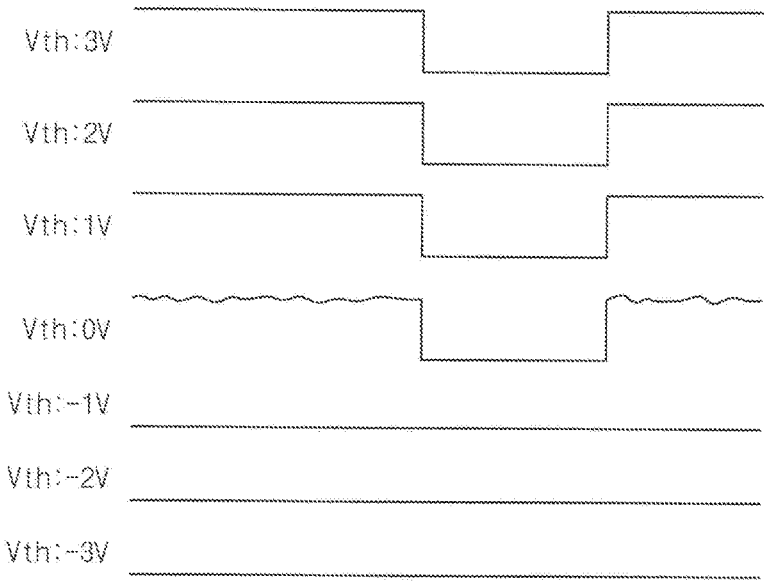
FIGS. 12A and 12B are waveforms for describing an effect of a stage of FIG. 11.
Figure 12B:
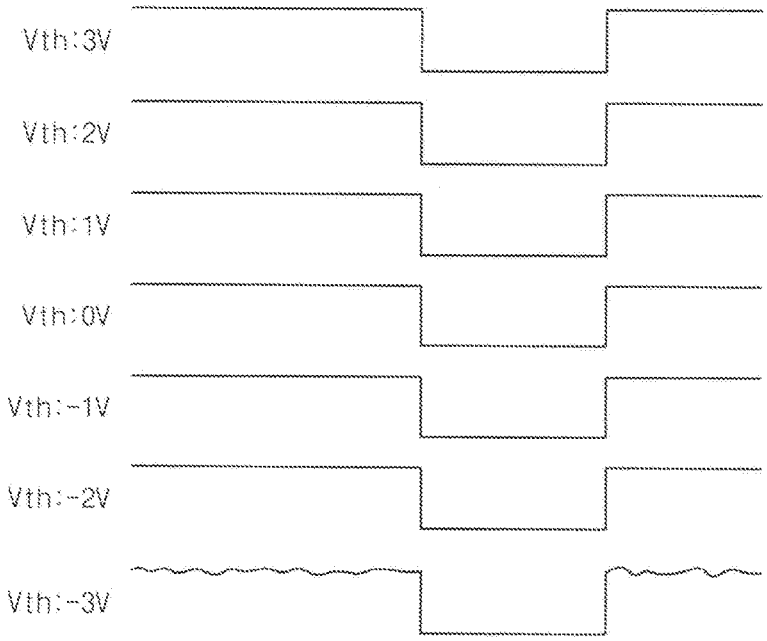

FIGS. 12A and 12B are waveforms for describing an effect of a stage of FIG. 11.

Referring to FIGS. 12A and 12B, two transistors connected to each other in series are located in each part (e.g., the stabilizing circuit, the second holding circuit) of the stage in which the leakage current occurs, and then a leakage current blocking circuit applies high level voltage to the node between two transistors, thereby preventing or reducing the leakage current.

As shown in FIG. 12A, for a case in which a stage does not include the leakage current blocking circuit, the emission control signal had a ripple or the emission control signal was abnormally outputted when threshold voltages of transistors are less than or equal to 0V. Thus, when the threshold voltages of transistors move in the negative direction, the emission control signal had a ripple or the emission control signal was abnormally outputted. Accordingly, images displayed by the display device had spots or the display device abnormally displayed images.

On the other hand, as shown in FIG. 12B, for a case in which each of the stabilizing circuit and the second holding circuit includes two transistors that are connected to each other in series, and the leakage current blocking circuit applies the high level voltage to nodes between the two respective transistors, the emission control signal had a ripple when threshold voltages of transistors are less than or equal to −3V. Thus, as shown in [TABLE 2], the emission control signal was stably outputted when the threshold voltages of transistors are greater than or equal to −2V.

TABLE 2

| | REF | | STGD | |
|---|---|---|---|---|
| Vth | EM High | EM Low | EM High | EM Low |
| 5 | 34 | −2 | 34 | −2 |
| 4 | 34 | −2 | 34 | −2 |
| 3 | 34 | −2 | 34 | −2 |
| 2 | 34 | −2 | 34 | −2 |
| 1 | 34 | −2 | 34 | −2 |
| 0 | 33.4 | −1.99 | 34 | −2 |
| −1 | X | X | 34 | −2 |
| −2 | X | X | 34 | −1.97 |
| −3 | X | X | 33.2 | −1.92 |
| −4 | X | X | 31.8 | −1.84 |
| −5 | X | X | 29.5 | −1.72 |

Here, REF indicates a stage not including a leakage current blocking circuit, STGD indicates a stage described in FIG. 11, Vth indicates a threshold voltage of transistors in the stage, EM High indicates a voltage of an emission control signal corresponding to a high level, and EM Low indicates a voltage of the emission control signal corresponding to a low level.

Figure 13:
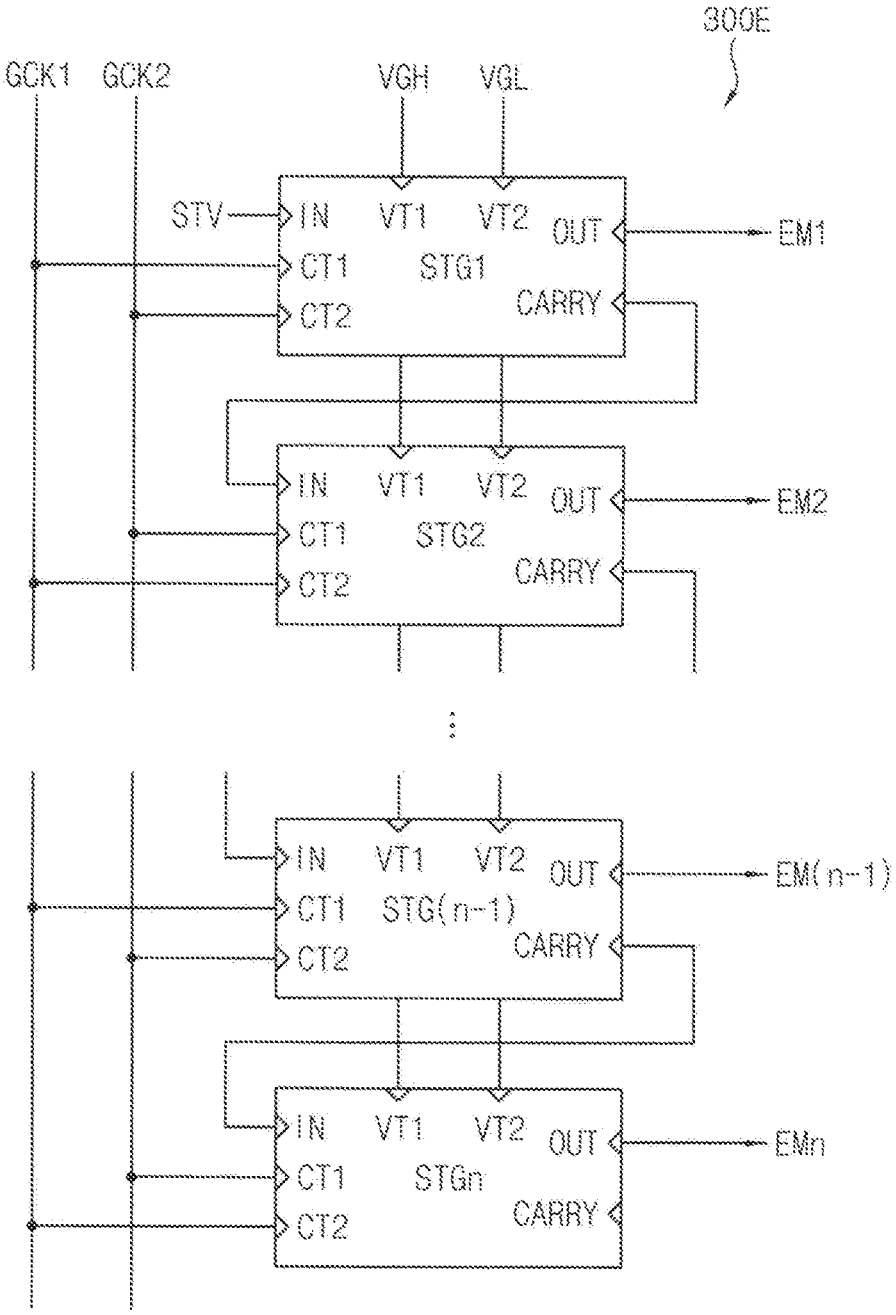
FIG. 13 is a block diagram illustrating still another example of an emission control driver included in a display device of FIG. 1.

FIG. 13 is a block diagram illustrating still another example of an emission control driver included in a display device of FIG. 1.

Referring to FIG. 13, the emission control driver 300E may include a plurality of stages STG1 through STGn. Each of the stages STG1 through STGn may output an emission control signal. Each of the stages STG1 through STGn may include an input terminal IN, a first clock terminal CT1, a second clock terminal CT2, a first power terminal VT1, a second power terminal VT2, an output terminal OUT, and a carry terminal CARRY. The emission control driver 300E according to the present exemplary embodiment is substantially the same as the driver 300A of the exemplary embodiment described in FIG. 3, except that the carry terminal CARRY is added. Therefore, the same reference numerals will be used to refer to the same or like parts as those described in the previous exemplary embodiment of FIG. 3 and any repetitive explanation concerning the above elements will be omitted.

A vertical start signal STV or a previous carry signal outputted from one of the previous stages may be applied to the input terminals IN of the stages STG1 through STGn. For example, the vertical start signal STV is applied to the input terminal IN of the first stage STG1. The immediately previous emission control signals may be respectively applied to each input terminal IN of the other stages SRC2 through SRCn.

The emission control signals may be outputted to the emission control lines via the output terminals OUT of the stages STG1 through STGn, respectively. Each carry signal may be outputted via the carry terminal CARRY to the next stage.

Figure 14:
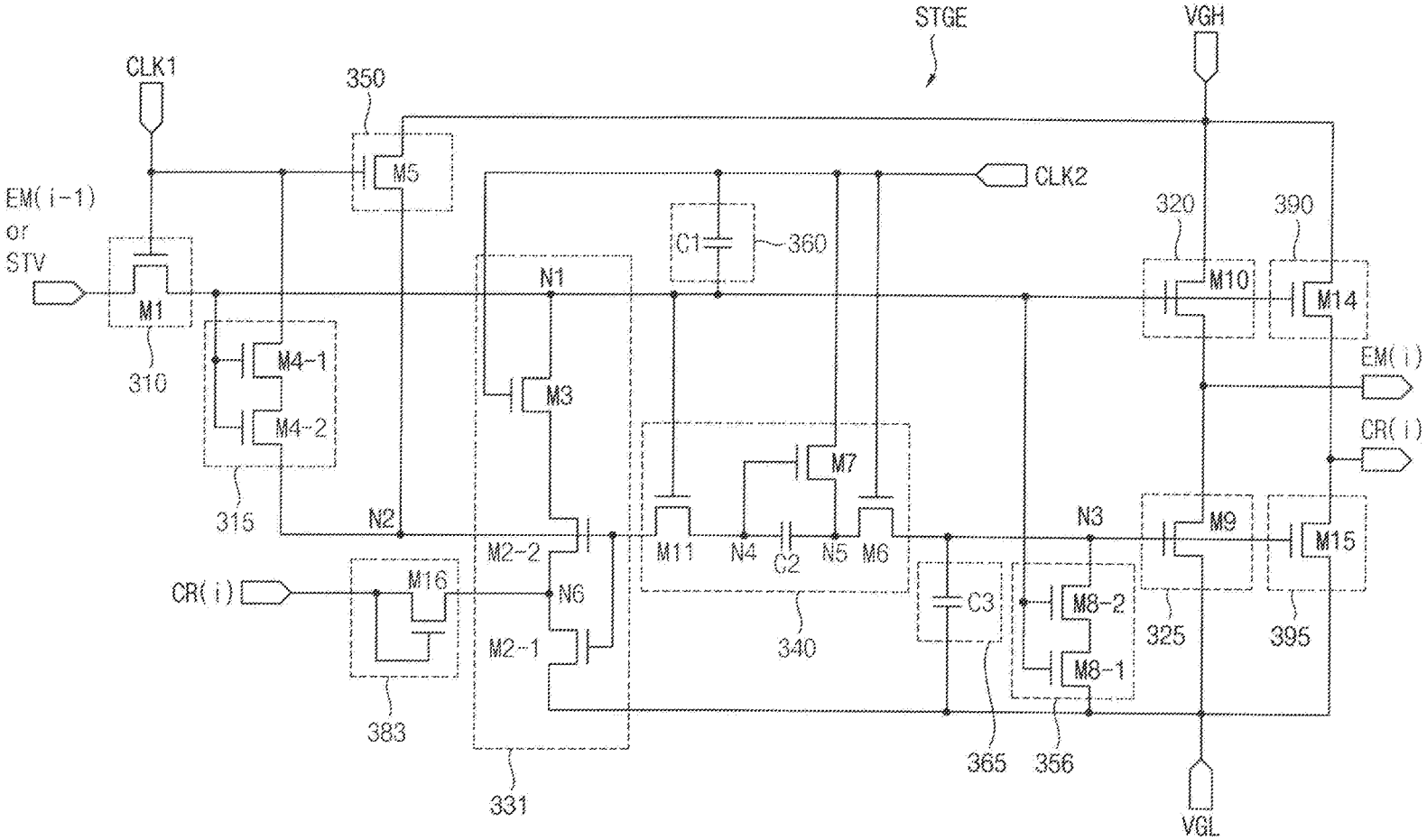
FIG. 14 is a circuit diagram illustrating one example of a stage included in an emission control driver of FIG. 13.

FIG. 14 is a circuit diagram illustrating one example of a stage included in an emission control driver 300E of FIG. 13.

Referring to FIG. 14, a stage STGE of the emission control driver may include a first input circuit 310, a second input circuit 315, a first output circuit 320, a second output circuit 325, a stabilizing circuit 331, a voltage adjusting circuit 340, a first holding circuit 350, a second holding circuit 356, a first carry output circuit 390, a second carry output circuit 395, and a third leakage current blocking circuit 383. The first input circuit 310, the second input circuit 315, the first output circuit 320, the second output circuit 325, the voltage adjusting circuit 340, and the first holding circuit 350 according to the present exemplary embodiment are substantially the same as the first input circuit, the second input circuit, the first output circuit, the second output circuit, the voltage adjusting circuit, and the first holding circuit of the exemplary embodiment described in FIG. 4. Therefore, the same reference numerals will be used to refer to the same or like parts as those described in the previous exemplary embodiment of FIG. 4, and any repetitive explanation concerning the above elements will be omitted.

The first carry output circuit 390 may control the carry signal CR(i) to the first logic level in response to the voltage of the first node N1. In one example embodiment, the first carry output circuit 390 may include a first carry transistor M14. The first carry transistor M14 may include a gate electrode connected to the first node N1, a first electrode receiving the first power voltage VGH, and a second electrode connected to a carry terminal to which the carry signal CR(i) is outputted.

The second carry output circuit 395 may control the carry signal CR(i) to the second logic level in response to the voltage of the third node N3. In one example embodiment, the second carry output circuit 395 may include a second carry transistor M15. The second carry transistor M15 may include a gate electrode connected to the third node N3, a first electrode receiving the second power voltage VGL, and a second electrode connected to the carry terminal.

The stage STGE may output the emission control signal EM(i) and the carry signal CR(i). The stage STGE may output the carry signal CR(i) as an input signal to the immediately subsequent stage instead of the emission control signal EM(i) or a feedback signal of the current stage, thereby reducing rising time and falling time of the emission control signal and more stably outputting the emission control signal EM(i). In this case, sizes of the first and second carry transistors M14 and M15 can be smaller than sizes of the first and second output transistors M10 and M9, because the carry signal CR(i) is used as the input signal of the next stage or the feedback signal. For example, widths of the first and second carry output transistor M14 and M15 may be about 90 micrometers.

The stabilizing circuit 331 may stabilize the emission control signal EM(i) in response to the voltage of the second node N2 and a second clock signal CLK2. In one example embodiment, the stabilizing circuit 331 may include a first stabilizing transistor M2-1, a second stabilizing transistor M2-2, and a third stabilizing transistor M3. The first stabilizing transistor M2-1 may include a gate electrode connected to the second node N2, a first electrode receiving a second power voltage VGL, and a second electrode connected to the sixth node N6. The second stabilizing transistor M2-2 may include a gate electrode connected to the second node N2, a first electrode connected to the sixth node N6, and a second electrode. The third stabilizing transistor M3 may include a gate electrode receiving the second clock signal CLK2, a first electrode connected to the second electrode of the second stabilizing transistor M2-2, and a second electrode connected to the first node N1.

The third leakage current blocking circuit 383 may apply the carry signal CR(i) to the sixth node N6 in response to the carry signal CR(i). In one example embodiment, the third leakage current blocking circuit 383 may include a third blocking transistor M16. The third blocking transistor M16 may include a gate electrode connected to the carry terminal, a first electrode connected to the carry terminal, and a second electrode connected to the sixth node N6.

Thus, the stabilizing circuit 331 includes a plurality of transistors that are connected to each other in series. Accordingly, when the voltage of the first node N1 corresponds to a high level voltage, the stabilizing circuit 331 may reduce the leakage current flowing from the first node N1 to the second power terminal to which the second power voltage VGL is provided. In addition, when the voltage of the carry signal corresponds to a high level voltage, the third leakage current blocking circuit 383 may set the voltage of the sixth node N6 in the stabilizing circuit 331 to the high level voltage to reduce or prevent the leakage current from flowing from the first node N1 to the second power terminal.

The second holding circuit 356 may maintain the voltage of the third node N3 as the second logic level in response to the voltage of the first node N1. In one example embodiment, the second holding circuit 356 may include a first holding transistor M8-1 and a second holding transistor M8-2. The first holding transistor M8-1 may include a gate electrode connected to the first node N1, a first electrode receiving a second power voltage VGL, and a second electrode. The second holding transistor M8-2 may include a gate electrode connected to the first node N1, a first electrode connected to the second electrode of the first holding transistor M8-1, and a second electrode connected to the third node N3. The second holding circuit 356 includes two transistors that are connected to each other in series to reduce the leakage current flowing from the third node N3 to the second power terminal when the voltage of the third node N3 corresponds to a high level.

Figure 15A:
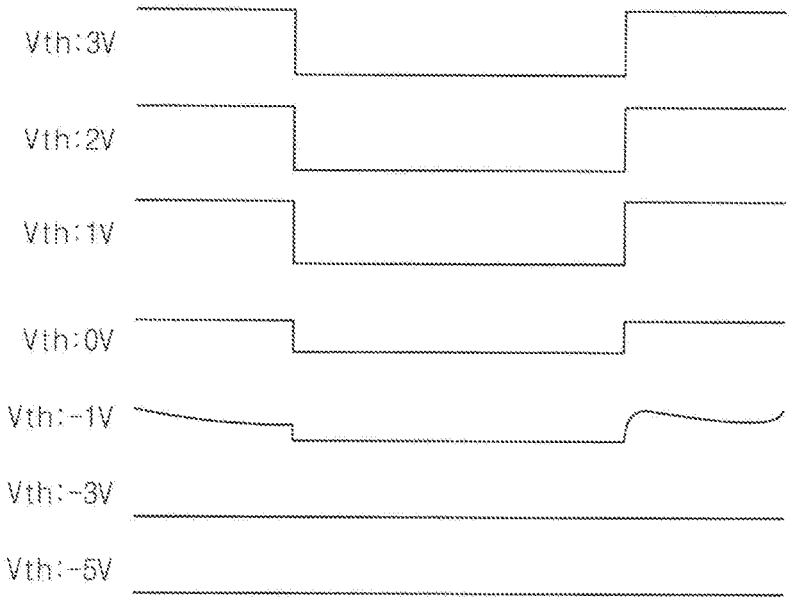
FIGS. 15A and 15B are waveforms for describing an effect of a stage of FIG. 14.
Figure 15B:
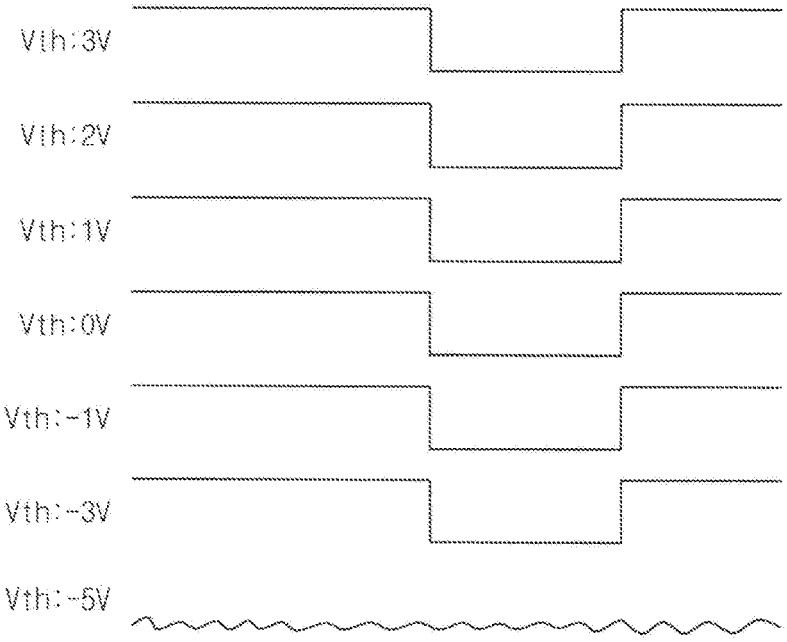

FIGS. 15A and 15B are waveforms for describing an effect of a stage of FIG. 14.

Referring to FIGS. 15A and 15B, two transistors connected to each other in series are located in the stabilizing circuit in which the leakage current occurs, and then a leakage current blocking circuit applies high level voltage to the node between the two transistors, thereby preventing or reducing the leakage current.

As shown in FIG. 15A, for the case in which a stage does not include the third leakage current blocking circuit, the emission control signal had a ripple or the emission control signal was abnormally outputted when threshold voltages of transistors are less than or equal to 0V. Thus, when the threshold voltages of transistors move in the negative direction, the emission control signal had a ripple or the emission control signal was abnormally outputted. Accordingly, images displayed by the display device had spots or the display device abnormally displayed images.

On the other hand, as shown in FIG. 15B, for the case in which the stabilizing circuit includes two transistors that are connected to each other in series, and the leakage current blocking circuit applies the high level voltage to the sixth node between the two transistors, the emission control signal was stably outputted when the threshold voltages of transistors are greater than or equal to −4V.

Figure 16:
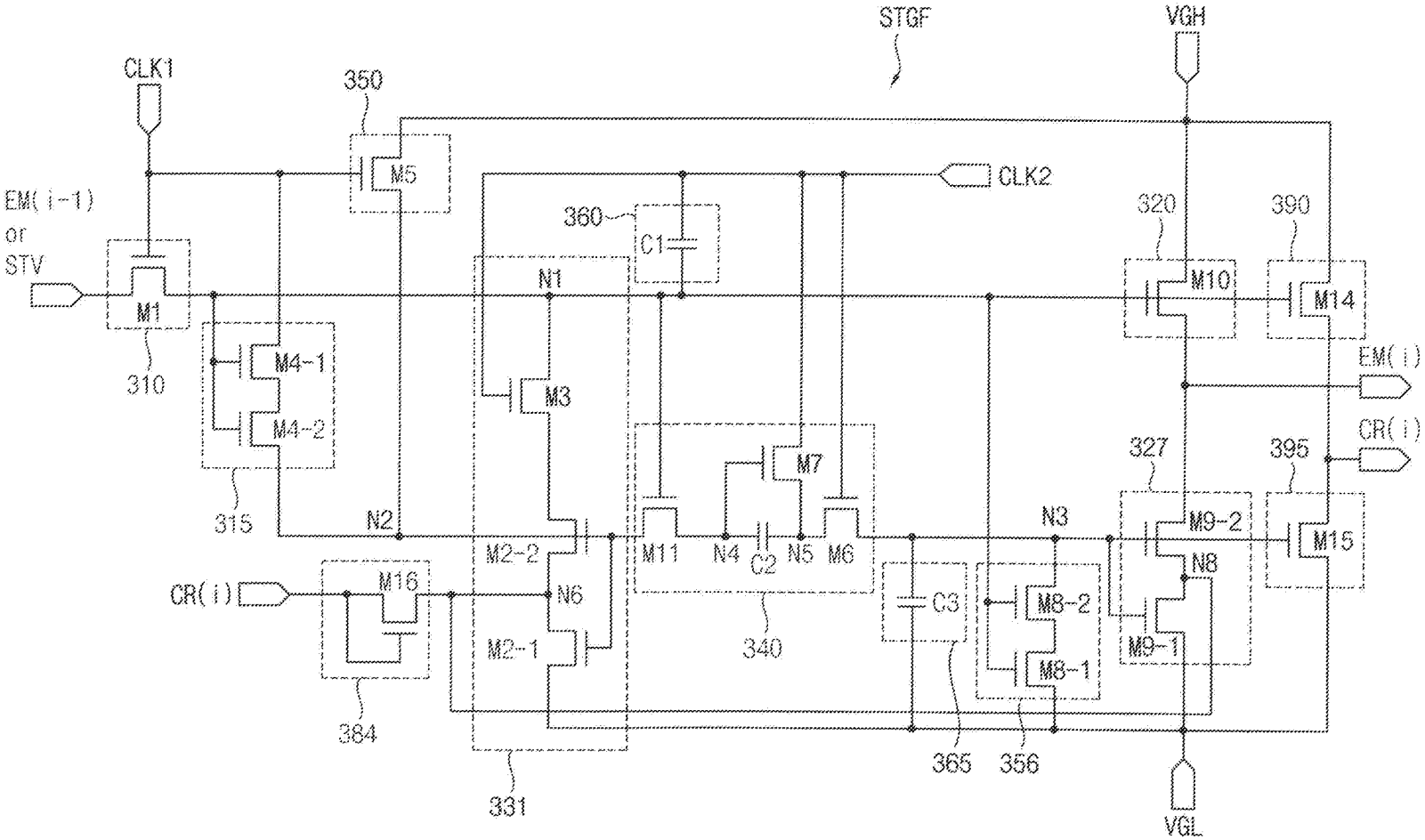
FIG. 16 is a circuit diagram illustrating another example of a stage included in an emission control driver of FIG. 13.

FIG. 16 is a circuit diagram illustrating another example of a stage included in an emission control driver 300E of FIG. 13.

Referring to FIG. 16, a stage STGF of the emission control driver may include a first input circuit 310, a second input circuit 315, a first output circuit 320, a second output circuit 327, a stabilizing circuit 331, a voltage adjusting circuit 340, a first holding circuit 350, a second holding circuit 356, a first carry output circuit 390, a second carry output circuit 395, and a third leakage current blocking circuit 384. The stage STGF according to the present exemplary embodiment is substantially the same as the stage STGE of the exemplary embodiment described in FIG. 14, except for a structure of the second output circuit 327. Therefore, the same reference numerals will be used to refer to the same or like parts as those described in the previous exemplary embodiment of FIG. 14, and any repetitive explanation concerning the above elements will be omitted.

The second output circuit 327 may control the emission control signal EM(i) to a second logic level in response to the voltage of the third node N3. In one example embodiment, the second output circuit 327 may include a third output transistor M9-1 and a fourth output transistor M9-2. The third output transistor M9-1 may include a gate electrode connected to the third node N3, a first electrode receiving a second power voltage VGL, and a second electrode connected to the eighth node N8. The fourth output transistor M9-2 may include a gate electrode connected to the third node N3, a first electrode connected to the eighth node N8, and a second electrode connected to an output terminal to which the emission control signal EM(i) is outputted.

The third leakage current blocking circuit 384 may apply the carry signal CR(i) to the eighth node N8 in response to the carry signal CR(i). In one example embodiment, the third leakage current blocking circuit 384 may include a third blocking transistor M16. The third blocking transistor M16 may include a gate electrode connected to the carry terminal, a first electrode connected to the carry terminal, and a second electrode connected to the eighth node N8 (as well as to a sixth node N6).

Thus, when the voltage of the third node N3 corresponds to a low level voltage and the voltage of the emission control signal corresponds to the high level voltage, the third leakage current blocking circuit 384 may set the voltage of the eighth node N8 in the second output circuit 327 to the high level voltage to prevent the leakage current from flowing from the output terminal to the second power terminal to which the second power voltage VGL is provided.

Figure 17:
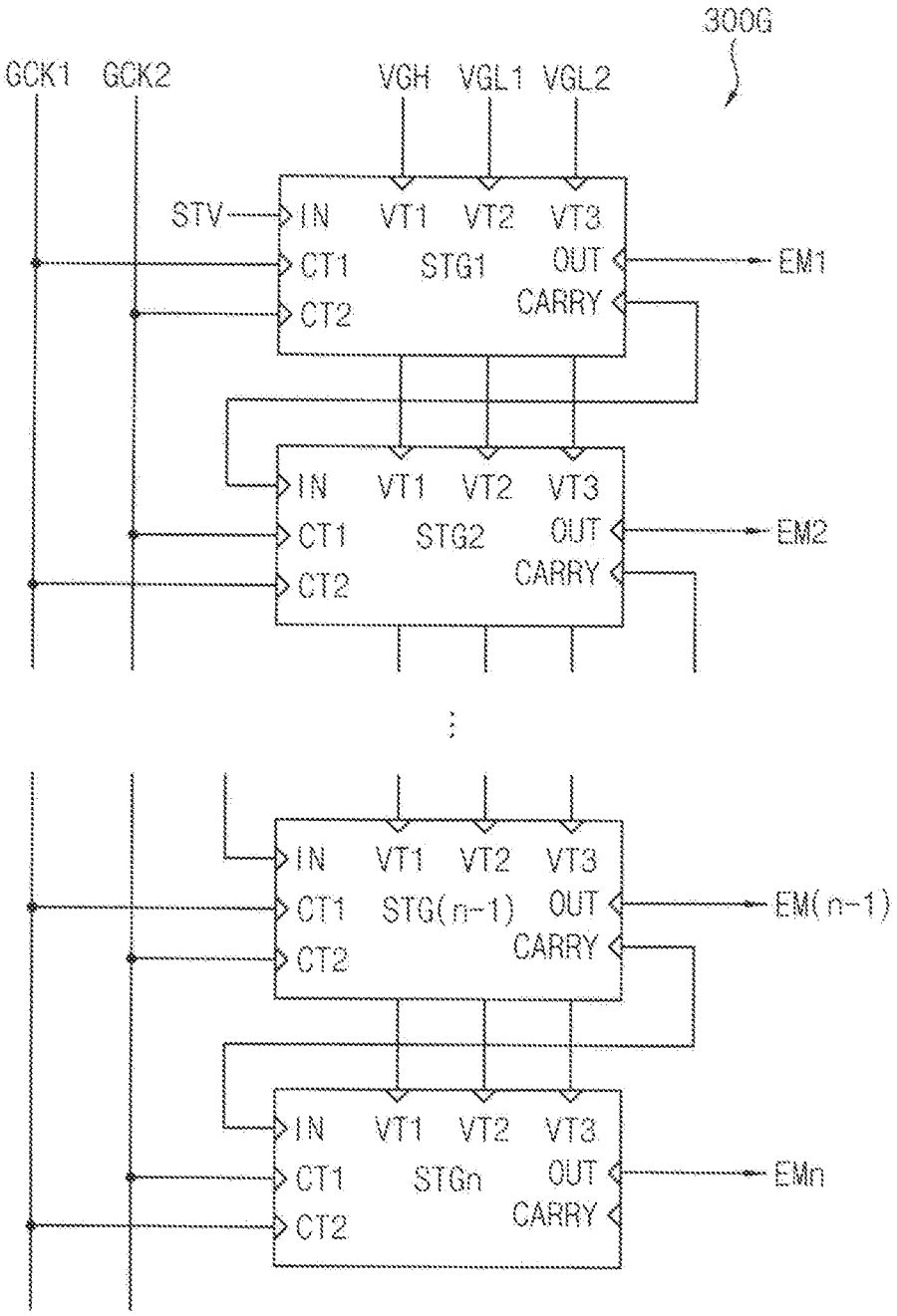
FIG. 17 is a block diagram illustrating still another example of an emission control driver included in a display device of FIG. 1.

FIG. 17 is a block diagram illustrating still another example of an emission control driver included in a display device of FIG. 1.

Referring to FIG. 17, the emission control driver 300G may include a plurality of stages STG1 through STGn. Each of the stages STG1 through STGn may output an emission control signal. Each of the stages STG1 through STGn may include an input terminal IN, a first clock terminal CT1, a second clock terminal CT2, a first power terminal VT1, a second power terminal VT2, a third power terminal VT3, an output terminal OUT, and a carry terminal CARRY. The emission control driver 300G according to the present exemplary embodiment is substantially the same as the driver 300E of the exemplary embodiment described in FIG. 13, except that the third power terminal VT3 is added. Therefore, the same reference numerals will be used to refer to the same or like parts as those described in the previous exemplary embodiment of FIG. 13, and any repetitive explanation concerning the above elements will be omitted.

A first power voltage VGH corresponding to a first logic level may be provided to the first power terminals VT1 of the stages STG1 through STGn. For example, the first power voltage VGH may correspond to a high level voltage. A second power voltage VGL1 corresponding to a second logic level may be provided to the second power terminals VT2 of the stages STG1 through STGn. For example, the second power voltage VGL1 may correspond to a first low level. A third power voltage VGL2 corresponding to the second logic level may be provided to the third power terminals VT3 of the stages STG1 through STGn. For example, the third power voltage VGL2 may correspond to a second low level higher than the first low level.

Figure 18:
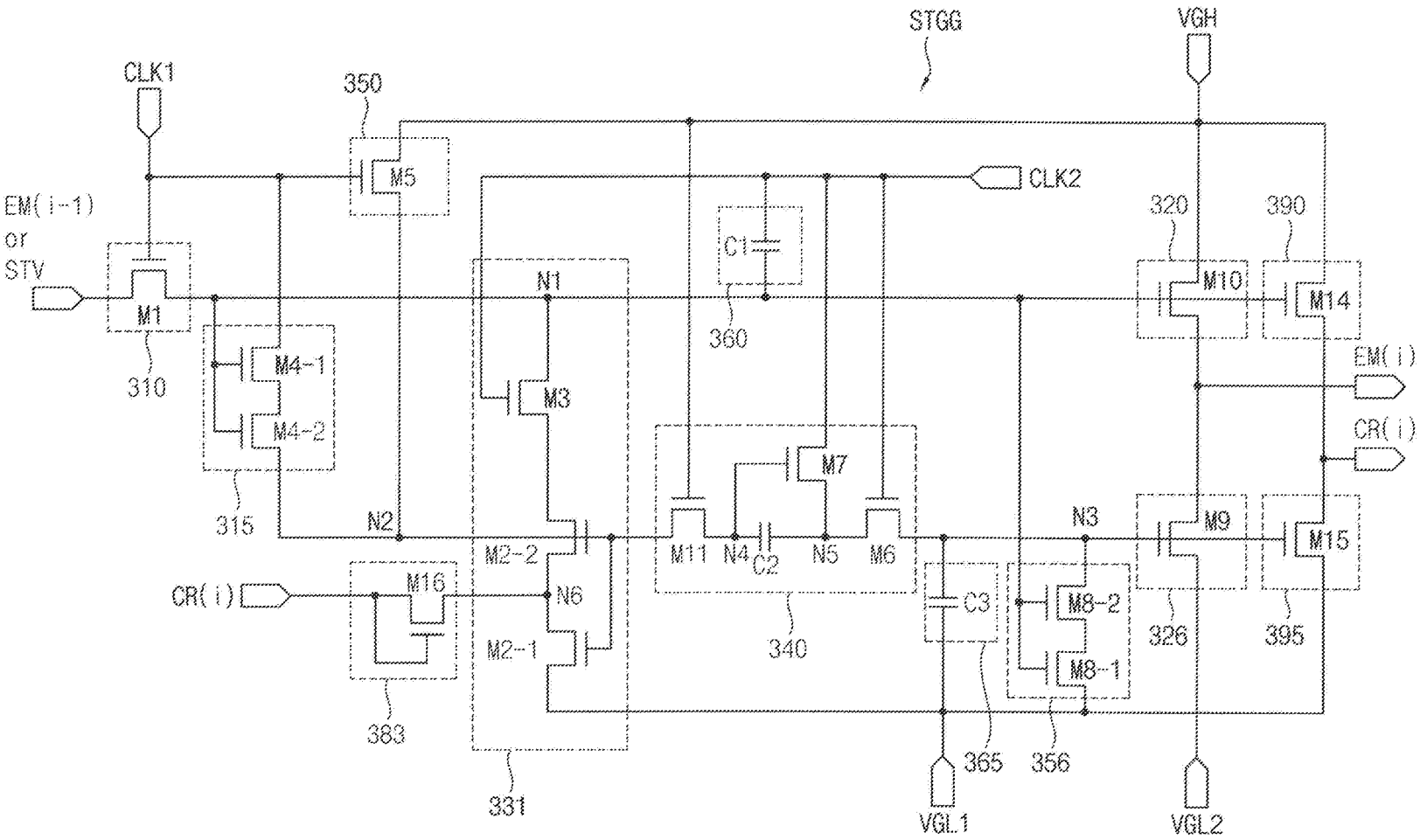
FIG. 18 is a circuit diagram illustrating one example of a stage included in an emission control driver of FIG. 17.

FIG. 18 is a circuit diagram illustrating one example of a stage included in an emission control driver of FIG. 17.

Referring to FIG. 18, a stage STGG of the emission control driver may include a first input circuit 310, a second input circuit 315, a first output circuit 320, a second output circuit 326, a stabilizing circuit 331, a voltage adjusting circuit 340, a first holding circuit 350, a second holding circuit 356, a first carry output circuit 390, a second carry output circuit 395, and a third leakage current blocking circuit 383. The stage STGG according to the present exemplary embodiment is substantially the same as the stage STGE of the exemplary embodiment described in FIG. 14, except that the second output circuit 326 is connected to the third power terminal to which the third power voltage VGL2 is provided. Therefore, the same reference numerals will be used to refer to the same or like parts as those described in the previous exemplary embodiment of FIG. 14, and any repetitive explanation concerning the above elements will be omitted.

The stage STGG may receive the second and third power voltages VGL1 and VGL2 that both correspond to the second logic level, to prevent the leakage current. In one example embodiment, the third power voltage VGL2 may be higher than the second power voltage VGL1. Thus, the stabilizing circuit 331 and the second holding circuit 356 may set the voltage of the first and third nodes N1 and N3 to the second power voltage VGL1 (i.e., the first low level). In contrast, the second output circuit 326 may set the emission control signal EM(i) to the third power voltage VGL2 (i.e., the second low level). Accordingly, when the second power voltage VGL1 (i.e., the first low level) is applied to the gate electrode of the first output transistor M10, the third power voltage VGL2 (i.e., the second low level) higher than the second power voltage VGL1 is applied to the second electrode of the first output transistor M10.

Therefore, the leakage current flowing from the first electrode to the second electrode of the first output transistor M10 can be reduced. In addition, when the second power voltage VGL1 is applied to the gate electrode of the second output transistor M9, the third power voltage VGL2 greater than the second power voltage VGL1 is applied to the first electrode of the second output transistor M9. Therefore, the leakage current flowing from the second electrode to the first electrode of the second output transistor M9 can be reduced.

In one example embodiment, a first width-to-length ratio of the first output transistor M10 may be smaller than a second width-to-length ratio of the second output transistor M9. Since sizes of the first and second output transistors M10 and M9 are described above, redundant description will be omitted.

Figure 19A:
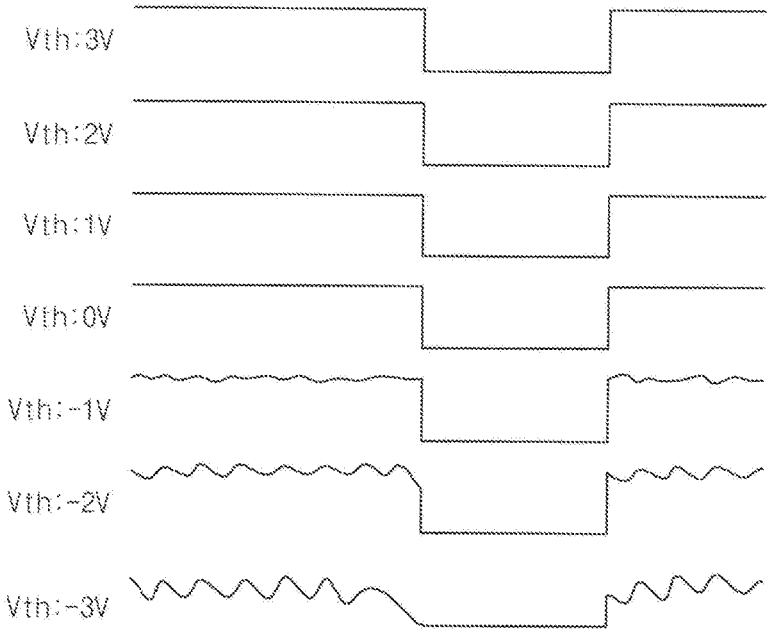
FIGS. 19A and 19B are waveforms for describing an effect of a stage of FIG. 18.
Figure 19B:
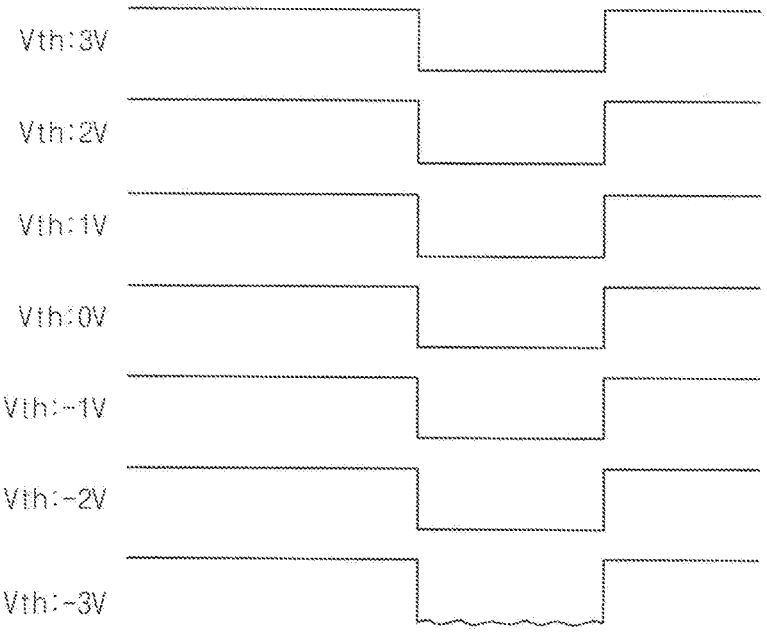

FIGS. 19A and 19B are waveforms for describing an effect of a stage of FIG. 18.

Referring to FIGS. 19A and 19B, two transistors connected to each other in series are located in the stabilizing circuit in which the leakage current occurs, and then a leakage current blocking circuit applies a high level of the carry signal to the node between the two transistors, thereby preventing or reducing leakage current.

As shown in FIG. 19A, for the case in which a stage does not include the third leakage current blocking circuit, the emission control signal had a ripple or the emission control signal was abnormally outputted when threshold voltages of transistors are less than or equal to −1V.

On the other hand, as shown in FIG. 19B, for the case in which the stabilizing circuit includes two transistors that are connected to each other in series, and the leakage current blocking circuit applies a high level voltage to the node between the two transistors, the emission control signal was stably outputted when the threshold voltages of transistors are greater than or equal to −3V. Thus, as shown in [TABLE 3], the emission control signal was stably outputted when the threshold voltages of transistors are greater than or equal to −2V.

TABLE 3

| | REF | | EXP (STGG) | |
|---|---|---|---|---|
| Vth | EM High | EM Low | EM High | EM Low |
| 5 | 38 | −2 | 38 | −2 |
| 4 | 38 | −2 | 38 | −2 |
| 3 | 38 | −2 | 38 | −2 |
| 2 | 38 | −2 | 38 | −2 |
| 1 | 38 | −2 | 38 | −2 |
| 0 | 36.5 | −1.98 | 38 | −1.98 |
| −1 | 34.7 | −1.64 | 38 | −1.98 |
| −2 | X | X | 38 | −1.98 |
| −3 | X | X | 38 | −1.25 |
| −4 | X | X | 37.7 | 1.43 |
| −5 | X | X | 36.9 | 2.37 |

Here, REF indicates a stage not including the leakage current blocking circuit, STGG indicates a stage described in FIG. 18, Vth indicates a threshold voltage of transistors in the stage, EM High indicates a high level voltage of an emission control signal, and EM Low indicates a low level voltage of the emission control signal.

Figure 20:
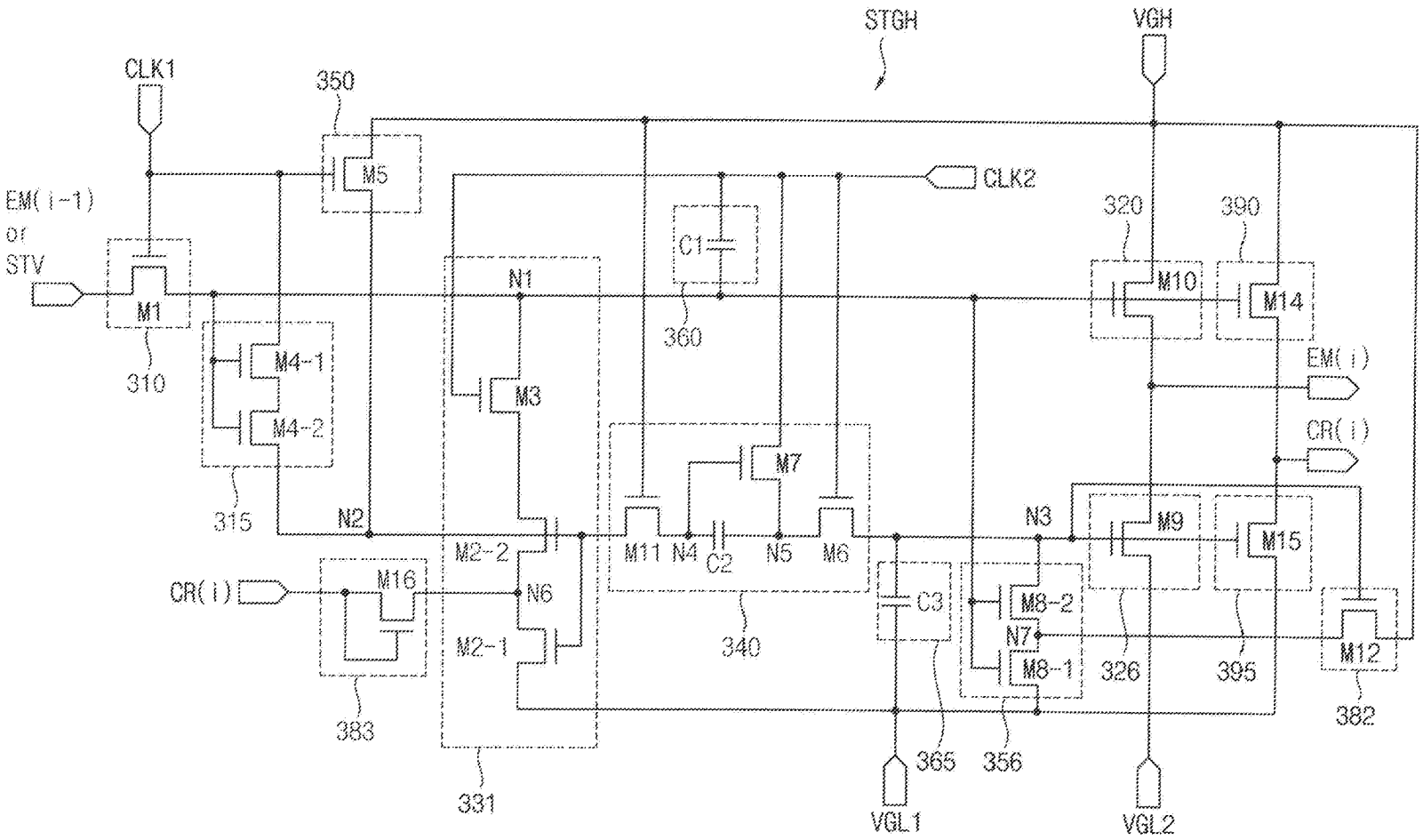
FIG. 20 is a circuit diagram illustrating another example of a stage included in an emission control driver of FIG. 17.

FIG. 20 is a circuit diagram illustrating another example of a stage included in an emission control driver of FIG. 17.

Referring to FIG. 20, a stage STGH of the emission control driver may include a first input circuit 310, a second input circuit 315, a first output circuit 320, a second output circuit 326, a stabilizing circuit 331, a voltage adjusting circuit 340, a first holding circuit 350, a second holding circuit 356, a first carry output circuit 390, a second carry output circuit 395, a second leakage current blocking circuit 382 and a third leakage current blocking circuit 383. The stage STGH according to the present exemplary embodiment is substantially the same as the stage STGG of the exemplary embodiment described in FIG. 18, except that the second leakage current blocking circuit 382 is added. Therefore, the same reference numerals will be used to refer to the same or like parts as those described in the previous exemplary embodiment of FIG. 18, and any repetitive explanation concerning the above elements will be omitted.

The second leakage current blocking circuit 382 may control a voltage of the seventh node N7 to the first logic level in response to the voltage of the third node N3. In one example embodiment, the second leakage current blocking circuit 382 may include a second blocking transistor M12. The second blocking transistor M12 may include a gate electrode connected to the third node N3, a first electrode receiving the first power voltage VGH, and a second electrode connected to the seventh node N7. When the voltage of the third node N3 corresponds to a high level voltage, the second leakage current blocking circuit 382 may set the voltage of the seventh node N7 in the second holding circuit 356 to the high level voltage to prevent a leakage current flowing from the third node N3 to the second power terminal VGL2.

Although an emission control driver and a display device having the emission control driver according to example embodiments have been described with reference to figures, those skilled in the art will readily appreciate that many modifications are possible in the example embodiments without materially departing from the novel teachings and advantages of the present inventive concept. For example, although the example embodiments describe that each stage includes n-channel metal oxide semiconductor (NMOS)-type transistors, various embodiments are not limited to this type of transistor. For example, each stage may instead include p-channel metal oxide semiconductor (PMOS)-type transistors.

The present inventive concept may be applied to an electronic device having the display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims. Various features of the above described and other embodiments can thus be mixed and matched in any manner, to produce further embodiments consistent with the invention.

What is claimed is:

1. An emission control driver comprising a plurality of stages configured to output a plurality of emission control signals respectively, wherein each stage includes:

an input circuit configured to receive a previous emission control signal from one of previous stages or a vertical start signal, and configured to control a voltage of a first node and a voltage of a second node in response to a first clock signal;

a stabilizing circuit configured to stabilize the voltage of the first node in response to the voltage of the second node and a second clock signal;

a voltage adjusting circuit connected between the second node and a third node, the voltage adjusting circuit configured to boost the voltage of the second node, and configured to control the boosted voltage of the second node; and an output circuit configured to control an emission control signal in response to the voltage of the first node and a voltage of the third node, and wherein the voltage adjusting circuit includes:

a node transistor including a gate electrode configured to receive a first power voltage, a first electrode connected to the second node, and a second electrode connected to a fourth node;

a first voltage adjusting transistor including a gate electrode connected to the fourth node, a first electrode configured to receive a third clock signal, and a second electrode connected to a fifth node;

a voltage adjusting capacitor including a first electrode connected to the fourth node and a second electrode connected to the fifth node; and a second voltage adjusting transistor including a gate electrode configured to receive the second clock signal, a first electrode connected to the fifth node, and a second electrode connected to the third node.

2. The emission control driver of claim 1, wherein the third clock signal is substantially the same as the second clock signal.

3. The emission control driver of claim 1, wherein a voltage of the third clock signal corresponding to a first logic level is lower than a voltage of the second clock signal corresponding to the first logic level.

4. The emission control driver of claim 1, wherein the stabilizing circuit includes:

a first stabilizing transistor including a gate electrode connected to the second node, a first electrode configured to receive a second power voltage, and a second electrode connected to a sixth node;

a second stabilizing transistor including a gate electrode connected to the second node, a first electrode connected to the sixth node, and a second electrode; and a third stabilizing transistor including a gate electrode configured to receive the second clock signal, a first electrode connected to the second electrode of the second stabilizing transistor, and a second electrode connected to the first node.

5. The emission control driver of claim 4, wherein each stage further includes:

a first leakage current blocking circuit configured to control a voltage of the sixth node to a first logic level in response to the voltage of the first node.

6. The emission control driver of claim 1, wherein the output circuit includes:

a first output circuit configured to control the emission control signal to a first logic level in response to the voltage of the first node; and a second output circuit configured to control the emission control signal to a second logic level in response to the voltage of the third node.

7. The emission control driver of claim 6, wherein each stage further includes:

a first holding circuit configured to maintain the voltage of the second node at the first logic level in response to the first clock signal; and a second holding circuit configured to maintain the voltage of the third node at the second logic level in response to the voltage of the first node.

8. The emission control driver of claim 7, wherein the second holding circuit includes:

a first holding transistor including a gate electrode connected to the first node, a first electrode configured to receive a second power voltage, and a second electrode connected to a seventh node; and a second holding transistor including a gate electrode connected to the first node, a first electrode connected to the seventh node, and a second electrode connected to the third node.

9. The emission control driver of claim 8, wherein each stage further includes:

a second leakage current blocking circuit configured to control a voltage of the seventh node to the first logic level in response to the voltage of the third node.

10. The emission control driver of claim 8, wherein the first output circuit includes a first output transistor including a gate electrode connected to the first node, a first electrode configured to receive a first power voltage, and a second electrode connected to an output terminal to which the emission control signal is output, and wherein the second output circuit includes a second output transistor including a gate electrode connected to the third node, a first electrode configured to receive a third power voltage, and a second electrode connected to the output terminal.

11. The emission control driver of claim 10, wherein the third power voltage is higher than the second power voltage.

12. The emission control driver of claim 10, wherein a first width-to-length ratio of the first output transistor is smaller than a second width-to-length ratio of the second output transistor.

13. An emission control driver comprising a plurality of stages configured to output a plurality of emission control signals respectively, wherein each stage includes:

an input circuit configured to receive a previous emission control signal from one of previous stages or a vertical start signal, and configured to control a voltage of a first node and a voltage of a second node in response to a first clock signal;

a stabilizing circuit configured to stabilize the voltage of the first node in response to the voltage of the second node and a second clock signal;

a voltage adjusting circuit connected between the second node and a third node, the voltage adjusting circuit configured to boost the voltage of the second node, and configured to control the boosted voltage of the second node; and an output circuit configured to control an emission control signal in response to the voltage of the first node and a voltage of the third node, and wherein the voltage adjusting circuit includes:

a first voltage adjusting transistor including a gate electrode connected to the second node, a first electrode configured to receive a third clock signal, and a second electrode connected to a fifth node;

a voltage adjusting capacitor including a first electrode connected to the second node and a second electrode connected to the fifth node; and a second voltage adjusting transistor including a gate electrode configured to receive the second clock signal, a first electrode connected to the fifth node, and a second electrode connected to the third node.

14. The emission control driver of claim 13, wherein each stage further includes:

a load reducing circuit including a node capacitor having a first electrode configured to receive the first clock signal and a second electrode connected to the second node.

15. The emission control driver of claim 13, wherein a voltage of the third clock signal corresponding to a first logic level is lower than a voltage of the second clock signal corresponding to the first logic level.

16. The emission control driver of claim 1, wherein the input circuit includes:

a first input circuit configured to apply the previous emission control signal or the vertical start signal to the first node in response to the first clock signal; and a second input circuit configured to apply the first clock signal to the second node in response to the voltage of the first node.

17. An emission control driver comprising a plurality of stages configured to output a plurality of emission control signals and a plurality of carry signals, wherein each stage includes:

an input circuit configured to receive a previous carry signal from one of previous stages or a vertical start signal, and configured to control a voltage of a first node and a voltage of a second node in response to a first clock signal;

a stabilizing circuit configured to stabilize the voltage of the first node in response to the voltage of the second node and a second clock signal;

a voltage adjusting circuit connected between the second node and a third node, the voltage adjusting circuit configured to boost the voltage of the second node, and configured to control the boosted voltage of the second node;

an output circuit configured to control an emission control signal in response to the voltage of the first node and a voltage of the third node; and a carry output circuit configured to control a carry signal in response to the voltage of the first node and the voltage of the third node, and wherein the stabilizing circuit includes:

a first stabilizing transistor including a gate electrode connected to the second node, a first electrode configured to receive a second power voltage, and a second electrode connected to a sixth node;

a second stabilizing transistor including a gate electrode connected to the second node, a first electrode connected to the sixth node, and a second electrode; and a third stabilizing transistor including a gate electrode configured to receive the second clock signal, a first electrode connected to the second electrode of the second stabilizing transistor, and a second electrode connected to the first node.

18. The emission control driver of claim 17, wherein each stage further includes:

a third leakage current blocking circuit configured to apply the carry signal to the sixth node in response to the carry signal.

19. The emission control driver of claim 17, wherein the output circuit includes:

a first output circuit configured to control the emission control signal to a first logic level in response to the voltage of the first node; and a second output circuit configured to control the emission control signal to a second logic level in response to the voltage of the third node, wherein the second output circuit includes:

a third output transistor including a gate electrode connected to the third node, a first electrode receiving a second power voltage, and a second electrode connected to an eighth node; and a fourth output transistor including a gate electrode connected to the third node, a first electrode connected to the eighth node, and a second electrode connected to an output terminal to which the emission control signal is output.

20. The emission control driver of claim 17, wherein the carry output circuit includes:

a first carry output circuit configured to control the carry signal to the first logic level in response to the voltage of the first node; and a second carry output circuit configured to control the carry signal to the second logic level in response to the voltage of the third node.

21. The emission control driver of claim 19, wherein each stage further includes:

a third leakage current blocking circuit configured to apply the carry signal to the eighth node in response to the carry signal.

22. A display device comprising:

a display panel including a plurality of scan lines, a plurality of emission control lines, a plurality of data lines, and a plurality of pixels;

a data driver configured to provide data signals to the pixels via the data lines;

a scan driver configured to provide scan signals to the pixels via the scan lines;

an emission control driver including a plurality of stages configured to output a plurality of emission control signals respectively, and configured to provide the emission control signals to the pixels via the emission control lines; and a controller configured to control the data driver, the scan driver, and the emission control driver, wherein each stage of the emission control driver includes:

an input circuit configured to receive a previous emission control signal from one of previous stages or a vertical start signal, and configured to control a voltage of a first node and a voltage of a second node in response to a first clock signal;

a stabilizing circuit configured to stabilize the voltage of the first node in response to the voltage of the second node and a second clock signal;

a voltage adjusting circuit connected between the second node and a third node, the voltage adjusting circuit configured to boost the voltage of the second node, and configured to control the boosted voltage of the second node; and an output circuit configured to control an emission control signal in response to the voltage of the first node and a voltage of the third node, and wherein the voltage adjusting circuit includes:

a node transistor including a gate electrode configured to receive a first power voltage, a first electrode connected to the second node, and a second electrode connected to a fourth node;

a first voltage adjusting transistor including a gate electrode connected to the fourth node, a first electrode configured to receive a third clock signal, and a second electrode connected to a fifth node;

a voltage adjusting capacitor including a first electrode connected to the fourth node and a second electrode connected to the fifth node; and a second voltage adjusting transistor including a gate electrode configured to receive the second clock signal, a first electrode connected to the fifth node, and a second electrode connected to the third node.

23. The display device of claim 22, wherein a voltage of the third clock signal corresponding to a first logic level is lower than a voltage of the second clock signal corresponding to the first logic level.

24. The display device of claim 22, wherein the controller is further configured to sense a magnitude of a current flowing through a power terminal of the emission control driver and to adjust a voltage of the third clock signal based on the sensed magnitude.

* * * * *